US009187990B2

(12) United States Patent
Xu

(10) Patent No.: US 9,187,990 B2
(45) Date of Patent: Nov. 17, 2015

(54) METHOD OF USING A DEGRADABLE SHAPED CHARGE AND PERFORATING GUN SYSTEM

(75) Inventor: Zhiyue Xu, Cypress, TX (US)

(73) Assignee: Baker Hughes Incorporated, Houston, TX (US)

( * ) Notice: Subject to any disclaimer, the term of this patent is extended or adjusted under 35 U.S.C. 154(b) by 774 days.

(21) Appl. No.: 13/225,415

(22) Filed: Sep. 3, 2011

(65) Prior Publication Data

US 2013/0056208 A1 Mar. 7, 2013

(51) Int. Cl.

| | |
|---|---|
| ***E21B 41/00*** | (2006.01) |
| ***E21B 43/117*** | (2006.01) |
| ***F42B 1/02*** | (2006.01) |
| ***F42B 3/08*** | (2006.01) |

(52) U.S. Cl.

CPC ..... *E21B 43/117* (2013.01); *E21B 41/00* (2013.01); *F42B 1/02* (2013.01); *F42B 3/08* (2013.01)

(58) Field of Classification Search

CPC ..... E21B 43/117; E21B 43/248
USPC ..... 175/2, 4.6
See application file for complete search history.

(56) References Cited

U.S. PATENT DOCUMENTS

| | | | |
|---|---|---|---|
| 2,238,895 | A | 4/1941 | Gage |
| 2,261,292 | A | 11/1941 | Salnikov |
| 2,294,648 | A | 9/1942 | Ansel et al. |
| 2,301,624 | A | 11/1942 | Holt |
| 2,754,910 | A | 7/1956 | Derrick et al. |
| 2,983,634 | A | 5/1961 | Budininkas et al. |
| 3,057,405 | A | 10/1962 | Mallinger |
| 3,106,959 | A | 10/1963 | Huitt et al. |
| 3,152,009 | A | 10/1964 | Delong |

(Continued)

FOREIGN PATENT DOCUMENTS

| | | | |
|---|---|---|---|
| CA | 2783241 | A1 | 6/2011 |
| CA | 2783346 | A1 | 6/2011 |

(Continued)

OTHER PUBLICATIONS

International Search Report and Written Opinion of the International Searching Authority mailed on Feb. 19, 2013, for International Application No. PCT/US2012/053342 filed on Aug. 31, 2012.

(Continued)

*Primary Examiner* — Jennifer H Gay
*Assistant Examiner* — Steven MacDonald
(74) *Attorney, Agent, or Firm* — Cantor Colburn LLP

(57) ABSTRACT

A method for perforating a formation interval in a well is disclosed. The method includes disposing a perforation gun comprising a shaped charge in the well proximate the formation interval, wherein the shaped charge comprises a charge case having a charge cavity, a liner disposed within the charge cavity and an explosive disposed within the charge cavity between the liner and the charge case, wherein the charge case and liner are each formed from a selectively corrodible powder compact material. The method also includes detonating the shaped charge to form a perforation tunnel in the formation interval and deposit a liner residue in the perforation tunnel The method further includes exposing the perforation gun and perforation tunnel to a predetermined wellbore fluid after detonating the shaped charge to remove a liner residue from the perforation tunnel and the charge case from the well.

15 Claims, 5 Drawing Sheets

(56) References Cited

U.S. PATENT DOCUMENTS

| | | | |
|---|---|---|---|
| 3,196,949 | A | 7/1965 | Thomas |
| 3,242,988 | A | 3/1966 | McGuire et al. |
| 3,316,748 | A | 5/1967 | Lang et al. |
| 3,326,291 | A | 6/1967 | Zandmer et al. |
| 3,347,317 | A | 10/1967 | Zandemer |
| 3,347,714 | A | 10/1967 | Broverman et al. |
| 3,390,724 | A | 7/1968 | Caldwell |
| 3,395,758 | A | 8/1968 | Kelly et al. |
| 3,406,101 | A | 10/1968 | Kilpatrick |
| 3,343,537 | A | 3/1969 | Zandmer |
| 3,465,181 | A | 9/1969 | Colby et al. |
| 3,513,230 | A | 5/1970 | Rhees et al. |
| 3,637,446 | A | 1/1972 | Elliott et al. |
| 3,645,331 | A | 2/1972 | Maurer et al. |
| 3,765,484 | A | 10/1973 | Hamby, Jr. et al. |
| 3,768,563 | A | 10/1973 | Blount |
| 3,775,823 | A | 12/1973 | Adolph et al. |
| 3,878,889 | A | 4/1975 | Seabourn |
| 3,894,850 | A | 7/1975 | Kovalchuk et al. |
| 3,924,677 | A | 12/1975 | Prenner et al. |
| 4,010,583 | A | 3/1977 | Highberg |
| 4,039,717 | A | 8/1977 | Titus |
| 4,050,529 | A | 9/1977 | Tagirov et al. |
| 4,157,732 | A | 6/1979 | Fonner |
| 4,248,307 | A | 2/1981 | Silberman et al. |
| 4,372,384 | A | 2/1983 | Kinney |
| 4,373,584 | A | 2/1983 | Silberman et al. |
| 4,373,952 | A | 2/1983 | Parent |
| 4,374,543 | A | 2/1983 | Richardson |
| 4,384,616 | A | 5/1983 | Dellinger |
| 4,395,440 | A | 7/1983 | Abe et al. |
| 4,399,871 | A | 8/1983 | Adkins et al. |
| 4,407,368 | A | 10/1983 | Erbstoesser |
| 4,422,508 | A | 12/1983 | Rutledge, Jr. et al. |
| 4,452,311 | A | 6/1984 | Speegle et al. |
| 4,475,729 | A | 10/1984 | Costigan |
| 4,498,543 | A | 2/1985 | Pye et al. |
| 4,499,048 | A | 2/1985 | Hanejko |
| 4,499,049 | A | 2/1985 | Hanejko |
| 4,526,840 | A | 7/1985 | Jerabek |
| 4,534,414 | A | 8/1985 | Pringle |
| 4,539,175 | A | 9/1985 | Lichti et al. |
| 4,554,986 | A | 11/1985 | Jones |
| 4,640,354 | A | 2/1987 | Boisson |
| 4,664,962 | A | 5/1987 | DesMarais, Jr. |
| 4,668,470 | A | 5/1987 | Gilman et al. |
| 4,673,549 | A | 6/1987 | Ecer |
| 4,674,572 | A | 6/1987 | Gallus |
| 4,678,037 | A | 7/1987 | Smith |
| 4,681,133 | A | 7/1987 | Weston |
| 4,688,641 | A | 8/1987 | Knieriemen |
| 4,693,863 | A | 9/1987 | Del Corso et al. |
| 4,703,807 | A | 11/1987 | Weston |
| 4,706,753 | A | 11/1987 | Ohkochi et al. |
| 4,708,202 | A | 11/1987 | Sukup et al. |
| 4,708,208 | A | 11/1987 | Halbardier |
| 4,709,761 | A | 12/1987 | Setterberg, Jr. |
| 4,714,116 | A | 12/1987 | Brunner |
| 4,716,964 | A | 1/1988 | Erbstoesser et al. |
| 4,721,159 | A | 1/1988 | Ohkochi et al. |
| 4,738,599 | A | 4/1988 | Shilling |
| 4,741,973 | A | 5/1988 | Condit et al. |
| 4,768,588 | A | 9/1988 | Kupsa |
| 4,784,226 | A | 11/1988 | Wyatt |
| 4,805,699 | A | 2/1989 | Halbardier |
| 4,817,725 | A | 4/1989 | Jenkins |
| 4,834,184 | A | 5/1989 | Streich et al. |
| H635 | H | 6/1989 | Johnson et al. |
| 4,850,432 | A | 7/1989 | Porter et al. |
| 4,853,056 | A | 8/1989 | Hoffman |
| 4,869,324 | A | 9/1989 | Holder |
| 4,869,325 | A | 9/1989 | Halbardier |
| 4,889,187 | A | 12/1989 | Terrell et al. |
| 4,890,675 | A | 1/1990 | Dew |
| 4,909,320 | A | 3/1990 | Hebert et al. |
| 4,929,415 | A | 5/1990 | Okazaki |
| 4,932,474 | A | 6/1990 | Schroeder, Jr. et al. |
| 4,938,309 | A | 7/1990 | Emdy |
| 4,938,809 | A | 7/1990 | Das et al. |
| 4,944,351 | A | 7/1990 | Eriksen et al. |
| 4,949,788 | A | 8/1990 | Szarka et al. |
| 4,952,902 | A | 8/1990 | Kawaguchi et al. |
| 4,975,412 | A | 12/1990 | Okazaki et al. |
| 4,977,958 | A | 12/1990 | Miller |
| 4,981,177 | A | 1/1991 | Carmody et al. |
| 4,986,361 | A | 1/1991 | Mueller et al. |
| 5,010,955 | A | 4/1991 | Springer |
| 5,036,921 | A | 8/1991 | Pittard et al. |
| 5,048,611 | A | 9/1991 | Cochran |
| 5,049,165 | A | 9/1991 | Tselesin |
| 5,061,323 | A | 10/1991 | DeLuccia |
| 5,063,775 | A | 11/1991 | Walker, Sr. et al. |
| 5,073,207 | A | 12/1991 | Faure et al. |
| 5,074,361 | A | 12/1991 | Brisco et al. |
| 5,076,869 | A | 12/1991 | Bourell et al. |
| 5,084,088 | A | 1/1992 | Okazaki |
| 5,087,304 | A | 2/1992 | Chang et al. |
| 5,090,480 | A | 2/1992 | Pittard et al. |
| 5,095,988 | A | 3/1992 | Bode |
| 5,103,911 | A | 4/1992 | Heijnen |
| 5,117,915 | A | 6/1992 | Mueller et al. |
| 5,161,614 | A | 11/1992 | Wu et al. |
| 5,178,216 | A | 1/1993 | Giroux et al. |
| 5,181,571 | A | 1/1993 | Mueller et al. |
| 5,188,182 | A | 2/1993 | Echols, III et al. |
| 5,188,183 | A | 2/1993 | Hopmann et al. |
| 5,204,055 | A | 4/1993 | Sachs et al. |
| 5,222,867 | A | 6/1993 | Walker, Sr. et al. |
| 5,226,483 | A | 7/1993 | Williamson, Jr. |
| 5,228,518 | A | 7/1993 | Wilson et al. |
| 5,234,055 | A | 8/1993 | Cornette |
| 5,252,365 | A | 10/1993 | White |
| 5,253,714 | A | 10/1993 | Davis et al. |
| 5,271,468 | A | 12/1993 | Streich et al. |
| 5,282,509 | A | 2/1994 | Schurr, III |
| 5,292,478 | A | 3/1994 | Scorey |
| 5,293,940 | A | 3/1994 | Hromas et al. |
| 5,304,260 | A | 4/1994 | Aikawa et al. |
| 5,309,874 | A | 5/1994 | Willermet et al. |
| 5,310,000 | A | 5/1994 | Arterbury et al. |
| 5,316,598 | A | 5/1994 | Chang et al. |
| 5,318,746 | A | 6/1994 | Lashmore |
| 5,380,473 | A | 1/1995 | Bogue et al. |
| 5,387,380 | A | 2/1995 | Cima et al. |
| 5,392,860 | A | 2/1995 | Ross |
| 5,394,941 | A | 3/1995 | Venditto et al. |
| 5,398,754 | A | 3/1995 | Dinhoble |
| 5,407,011 | A | 4/1995 | Layton |
| 5,409,555 | A | 4/1995 | Fujita et al. |
| 5,411,082 | A | 5/1995 | Kennedy |
| 5,417,285 | A | 5/1995 | Van Buskirk et al. |
| 5,425,424 | A | 6/1995 | Reinhardt et al. |
| 5,427,177 | A | 6/1995 | Jordan, Jr. et al. |
| 5,435,392 | A | 7/1995 | Kennedy |
| 5,439,051 | A | 8/1995 | Kennedy et al. |
| 5,454,430 | A | 10/1995 | Kennedy et al. |
| 5,456,317 | A | 10/1995 | Hood, III et al. |
| 5,456,327 | A | 10/1995 | Denton et al. |
| 5,464,062 | A | 11/1995 | Blizzard, Jr. |
| 5,472,048 | A | 12/1995 | Kennedy et al. |
| 5,474,131 | A | 12/1995 | Jordan, Jr. et al. |
| 5,477,923 | A | 12/1995 | Jordan, Jr. et al. |
| 5,479,986 | A | 1/1996 | Gano et al. |
| 5,507,439 | A | 4/1996 | Story |
| 5,526,880 | A | 6/1996 | Jordan, Jr. et al. |
| 5,526,881 | A | 6/1996 | Martin et al. |
| 5,529,746 | A | 6/1996 | Knoss et al. |
| 5,533,573 | A | 7/1996 | Jordan, Jr. et al. |
| 5,536,485 | A | 7/1996 | Kume et al. |
| 5,558,153 | A | 9/1996 | Holcombe et al. |
| 5,607,017 | A | 3/1997 | Owens et al. |
| 5,623,993 | A | 4/1997 | Van Buskirk et al. |
| 5,623,994 | A | 4/1997 | Robinson |
| 5,636,691 | A | 6/1997 | Hendrickson et al. |

(56) References Cited

U.S. PATENT DOCUMENTS 5,641,023 A 6/1997 Ross et al.
5,647,444 A 7/1997 Williams
5,665,289 A 9/1997 Chung et al.
5,677,372 A 10/1997 Yamamoto et al.
5,685,372 A 11/1997 Gano
5,701,576 A 12/1997 Fujita et al.
5,707,214 A 1/1998 Schmidt
5,709,269 A 1/1998 Head
5,720,344 A 2/1998 Newman
5,728,195 A 3/1998 Eastman et al.
5,765,639 A 6/1998 Muth
5,772,735 A 6/1998 Sehgal et al.
5,782,305 A 7/1998 Hicks
5,797,454 A 8/1998 Hipp
5,826,652 A 10/1998 Tapp
5,826,661 A 10/1998 Parker et al.
5,829,520 A 11/1998 Johnson
5,836,396 A 11/1998 Norman
5,857,521 A 1/1999 Ross et al.
5,881,816 A 3/1999 Wright
5,902,424 A 5/1999 Fujita et al.
5,934,372 A 8/1999 Muth
5,941,309 A 8/1999 Appleton
5,960,881 A 10/1999 Allamon et al.
5,985,466 A 11/1999 Atarashi et al.
5,990,051 A 11/1999 Ischy et al.
5,992,452 A 11/1999 Nelson, II
5,992,520 A 11/1999 Schultz et al.
6,007,314 A 12/1999 Nelson, II
6,024,915 A 2/2000 Kume et al.
6,032,735 A 3/2000 Echols
6,036,777 A 3/2000 Sachs
6,047,773 A 4/2000 Zeltmann et al.
6,050,340 A 4/2000 Scott
6,069,313 A 5/2000 Kay
6,076,600 A 6/2000 Vick, Jr. et al.
6,079,496 A 6/2000 Hirth
6,085,837 A 7/2000 Massinon et al.
6,095,247 A 8/2000 Streich et al.
6,119,783 A 9/2000 Parker et al.
6,142,237 A 11/2000 Christmas et al.
6,161,622 A 12/2000 Robb
6,167,970 B1 1/2001 Stout et al.
6,170,583 B1 1/2001 Boyce
6,173,779 B1 1/2001 Smith
6,189,616 B1 2/2001 Gano et al.
6,189,618 B1 2/2001 Beeman et al.
6,213,202 B1 4/2001 Read, Jr.
6,220,350 B1 4/2001 Brothers et al.
6,220,357 B1 4/2001 Carmichael et al.
6,228,904 B1 5/2001 Yadav et al.
6,237,688 B1 5/2001 Burleson et al.
6,238,280 B1 5/2001 Ritt et al.
6,241,021 B1 6/2001 Bowling
6,248,399 B1 6/2001 Hehmann
6,250,392 B1 6/2001 Muth
6,261,432 B1 7/2001 Huber et al.
6,273,187 B1 8/2001 Voisin, Jr. et al.
6,276,452 B1 8/2001 Davis et al.
6,276,457 B1 8/2001 Moffatt et al.
6,279,656 B1 8/2001 Sinclair et al.
6,287,445 B1 9/2001 Lashmore et al.
6,302,205 B1 10/2001 Ryll
6,315,041 B1 11/2001 Carlisle et al.
6,315,050 B2 11/2001 Vaynshteyn et al.
6,325,148 B1 12/2001 Trahan et al.
6,328,110 B1 12/2001 Joubert
6,341,653 B1 1/2002 Firmaniuk et al.
6,341,747 B1 1/2002 Schmidt et al.
6,349,766 B1 2/2002 Bussear et al.
6,354,379 B2 3/2002 Miszewski et al.
6,357,322 B1 3/2002 Dolan et al.
6,371,206 B1 4/2002 Mills
6,372,346 B1 4/2002 Toth
6,382,244 B2 5/2002 Vann
6,390,195 B1 5/2002 Nguyen et al.
6,390,200 B1 5/2002 Allamon et al.
6,394,185 B1 5/2002 Constien
6,397,950 B1 6/2002 Streich et al.
6,403,210 B1 6/2002 Stuivinga et al.
6,408,946 B1 6/2002 Marshall et al.
6,419,023 B1 7/2002 George et al.
6,439,313 B1 8/2002 Thomeer et al.
6,457,525 B1 10/2002 Scott
6,467,546 B2 10/2002 Allamon et al.
6,470,965 B1 10/2002 Winzer
6,491,097 B1 12/2002 Oneal et al.
6,491,116 B2 12/2002 Berscheidt et al.
6,513,598 B2 2/2003 Moore et al.
6,540,033 B1 4/2003 Sullivan et al.
6,543,543 B2 4/2003 Muth
6,561,275 B2 5/2003 Glass et al.
6,588,507 B2 7/2003 Dusterhoft et al.
6,591,915 B2 7/2003 Burris et al.
6,601,648 B2 8/2003 Ebinger
6,601,650 B2 8/2003 Sundararajan
6,609,569 B2 8/2003 Howlett et al.
6,612,826 B1 9/2003 Bauer et al.
6,613,383 B1 9/2003 George et al.
6,619,400 B2 9/2003 Brunet
6,634,428 B2 10/2003 Krauss et al.
6,662,886 B2 12/2003 Russell
6,675,889 B1 1/2004 Mullins et al.
6,699,305 B2 3/2004 Myrick
6,713,177 B2 3/2004 George et al.
6,715,541 B2 4/2004 Pedersen et al.
6,719,051 B2 4/2004 Hailey, Jr. et al.
6,755,249 B2 6/2004 Robison et al.
6,776,228 B2 8/2004 Pedersen et al.
6,779,599 B2 8/2004 Mullins et al.
6,799,638 B2 10/2004 Butterfield, Jr.
6,810,960 B2 11/2004 Pia
6,817,414 B2 11/2004 Lee
6,831,044 B2 12/2004 Constien
6,883,611 B2 4/2005 Smith et al.
6,887,297 B2 5/2005 Winter et al.
6,896,049 B2 5/2005 Moyes
6,896,061 B2 5/2005 Hriscu et al.
6,899,176 B2 5/2005 Hailey, Jr. et al.
6,899,777 B2 5/2005 Vaidyanathan et al.
6,908,516 B2 6/2005 Hehmann et al.
6,913,827 B2 7/2005 George et al.
6,926,086 B2 8/2005 Patterson et al.
6,932,159 B2 8/2005 Hovem
6,939,388 B2 9/2005 Angeliu
6,945,331 B2 9/2005 Patel
6,951,331 B2 10/2005 Haughom et al.
6,959,759 B2 11/2005 Doane et al.
6,973,970 B2 12/2005 Johnston et al.
6,973,973 B2 12/2005 Howard et al.
6,983,796 B2 1/2006 Bayne et al.
6,986,390 B2 1/2006 Doane et al.
7,013,989 B2 3/2006 Hammond et al.
7,013,998 B2 3/2006 Ray et al.
7,017,664 B2 3/2006 Walker et al.
7,017,677 B2 3/2006 Keshavan et al.
7,021,389 B2 4/2006 Bishop et al.
7,025,146 B2 4/2006 King et al.
7,028,778 B2 4/2006 Krywitsky
7,044,230 B2 5/2006 Starr et al.
7,049,272 B2 5/2006 Sinclair et al.
7,051,805 B2 5/2006 Doane et al.
7,059,410 B2 6/2006 Bousche et al.
7,090,027 B1 8/2006 Williams
7,093,664 B2 8/2006 Todd et al.
7,096,945 B2 8/2006 Richards et al.
7,096,946 B2 8/2006 Jasser et al.
7,097,906 B2 8/2006 Gardner
7,108,080 B2 9/2006 Tessari et al.
7,111,682 B2 9/2006 Blaisdell
7,141,207 B2 11/2006 Jandeska, Jr. et al.
7,150,326 B2 12/2006 Bishop et al.
7,163,066 B2 1/2007 Lehr
7,168,494 B2 1/2007 Starr et al.

(56) References Cited

U.S. PATENT DOCUMENTS 7,174,963 B2 2/2007 Bertelsen
7,182,135 B2 2/2007 Szarka
7,188,559 B1 3/2007 Vecchio
7,210,527 B2 5/2007 Walker et al.
7,210,533 B2 5/2007 Starr et al.
7,217,311 B2 5/2007 Hong et al.
7,234,530 B2 6/2007 Gass
7,250,188 B2 7/2007 Dodelet et al.
7,252,162 B2 8/2007 Akinlade et al.
7,255,172 B2 8/2007 Johnson
7,255,178 B2 8/2007 Slup et al.
7,264,060 B2 9/2007 Wills
7,267,172 B2 9/2007 Hofman
7,267,178 B2 9/2007 Krywitsky
7,270,186 B2 9/2007 Johnson
7,287,592 B2 10/2007 Surjaatmadja et al.
7,311,152 B2 12/2007 Howard et al.
7,316,274 B2 1/2008 Xu et al.
7,320,365 B2 1/2008 Pia
7,322,412 B2 1/2008 Badalamenti et al.
7,322,417 B2 1/2008 Rytlewski et al.
7,325,617 B2 2/2008 Murray
7,328,750 B2 2/2008 Swor et al.
7,331,388 B2 2/2008 Vilela et al.
7,337,854 B2 3/2008 Horn et al.
7,346,456 B2 3/2008 Le Bemadjiel
7,350,582 B2 4/2008 McKeachnie et al.
7,353,879 B2 4/2008 Todd et al.
7,360,593 B2 4/2008 Constien
7,360,597 B2 4/2008 Blaisdell
7,363,970 B2 4/2008 Corre et al.
7,384,443 B2 6/2008 Mirchandani
7,387,158 B2 6/2008 Murray et al.
7,387,165 B2 6/2008 Lopez De Cardenas et al.
7,392,841 B2 7/2008 Murray et al.
7,401,648 B2 7/2008 Richard
7,416,029 B2 8/2008 Telfer et al.
7,422,058 B2 9/2008 O'Malley
7,426,964 B2 9/2008 Lynde et al.
7,441,596 B2 10/2008 Wood et al.
7,445,049 B2 11/2008 Howard et al.
7,451,815 B2 11/2008 Hailey, Jr.
7,451,817 B2 11/2008 Reddy et al.
7,461,699 B2 12/2008 Richard et al.
7,464,764 B2 12/2008 Xu
7,472,750 B2 1/2009 Walker et al.
7,478,676 B2 1/2009 East, Jr. et al.
7,503,390 B2 3/2009 Gomez
7,503,399 B2 3/2009 Badalamenti et al.
7,509,993 B1 3/2009 Turng et al.
7,510,018 B2 3/2009 Williamson et al.
7,513,311 B2 4/2009 Gramstad et al.
7,527,103 B2 5/2009 Huang et al.
7,537,825 B1 5/2009 Wardle et al.
7,552,777 B2 6/2009 Murray et al.
7,552,779 B2 6/2009 Murray
7,559,357 B2 7/2009 Clem
7,575,062 B2 8/2009 East, Jr.
7,579,087 B2 8/2009 Maloney et al.
7,591,318 B2 9/2009 Tilghman
7,600,572 B2 10/2009 Slup et al.
7,604,049 B2 10/2009 Vaidya et al.
7,604,055 B2 10/2009 Richard et al.
7,617,871 B2 11/2009 Surjaatmadja et al.
7,635,023 B2 12/2009 Goldberg et al.
7,640,988 B2 1/2010 Phi et al.
7,661,480 B2 2/2010 Al-Anazi
7,661,481 B2 2/2010 Todd et al.
7,665,537 B2 2/2010 Patel et al.
7,686,082 B2 3/2010 Marsh
7,690,436 B2 4/2010 Turley et al.
7,699,101 B2 4/2010 Fripp et al.
7,703,510 B2 4/2010 Xu
7,703,511 B2 4/2010 Buyers et al.
7,708,078 B2 5/2010 Stoesz
7,709,421 B2 5/2010 Jones et al.
7,712,541 B2 5/2010 Loretz et al.
7,723,272 B2 5/2010 Crews et al.
7,726,406 B2 6/2010 Xu
7,735,578 B2 6/2010 Loehr et al.
7,752,971 B2 7/2010 Loehr
7,757,773 B2 7/2010 Rytlewski
7,762,342 B2 7/2010 Richard et al.
7,770,652 B2 8/2010 Barnett
7,775,284 B2 8/2010 Richards et al.
7,775,285 B2 8/2010 Surjaatmadja et al.
7,775,286 B2 8/2010 Duphorne
7,784,543 B2 8/2010 Johnson
7,793,714 B2 9/2010 Johnson
7,798,225 B2 9/2010 Giroux et al.
7,798,226 B2 9/2010 Themig
7,798,236 B2 9/2010 McKeachnie et al.
7,806,189 B2 10/2010 Frazier
7,806,192 B2 10/2010 Foster et al.
7,810,553 B2 10/2010 Cruickshank et al.
7,810,567 B2 10/2010 Daniels et al.
7,819,198 B2 10/2010 Birckhead et al.
7,828,055 B2 11/2010 Willauer et al.
7,833,944 B2 11/2010 Munoz et al.
7,849,927 B2 12/2010 Herrera
7,855,168 B2 12/2010 Fuller et al.
7,861,781 B2 1/2011 D'Arcy
7,874,365 B2 1/2011 East, Jr. et al.
7,878,253 B2 2/2011 Stowe et al.
7,896,091 B2 3/2011 Williamson et al.
7,897,063 B1 3/2011 Perry et al.
7,900,696 B1 3/2011 Nish et al.
7,900,703 B2 3/2011 Clark et al.
7,909,096 B2 3/2011 Clark et al.
7,909,104 B2 3/2011 Bjorgum
7,909,110 B2 3/2011 Sharma et al.
7,909,115 B2 3/2011 Grove et al.
7,913,765 B2 3/2011 Crow et al.
7,918,275 B2 4/2011 Clem
7,931,093 B2 4/2011 Foster et al.
7,938,191 B2 5/2011 Vaidya
7,946,335 B2 5/2011 Bewlay et al.
7,946,340 B2 5/2011 Surjaatmadja et al.
7,958,940 B2 6/2011 Jameson
7,963,331 B2 6/2011 Surjaatmadja et al.
7,963,340 B2 6/2011 Gramstad et al.
7,963,342 B2 6/2011 George
7,980,300 B2 7/2011 Roberts et al.
7,987,906 B1 8/2011 Troy
7,992,763 B2 8/2011 Vecchio et al.
8,020,619 B1 9/2011 Robertson et al.
8,020,620 B2 9/2011 Daniels et al.
8,025,104 B2 9/2011 Cooke, Jr.
8,028,767 B2 10/2011 Radford et al.
8,033,331 B2 10/2011 Themig
8,039,422 B1 10/2011 Al-Zahrani
8,056,628 B2 11/2011 Whitsitt et al.
8,056,638 B2 11/2011 Clayton et al.
8,109,340 B2 2/2012 Doane et al.
8,127,856 B1 3/2012 Nish et al.
8,153,052 B2 4/2012 Jackson et al.
8,163,060 B2 4/2012 Imanishi et al.
8,211,247 B2 7/2012 Marya et al.
8,211,248 B2 7/2012 Marya
8,226,740 B2 7/2012 Chaumonnot et al.
8,230,731 B2 7/2012 Dyer et al.
8,231,947 B2 7/2012 Vaidya et al.
8,276,670 B2 10/2012 Patel
8,277,974 B2 10/2012 Kumar et al.
8,297,364 B2 10/2012 Agrawal et al.
8,327,931 B2 12/2012 Agrawal et al.
8,403,037 B2 3/2013 Agrawal et al.
8,425,651 B2 4/2013 Xu et al.
2001/0045285 A1 11/2001 Russell
2001/0045288 A1 11/2001 Allamon et al.
2002/0000319 A1 1/2002 Brunet
2002/0007948 A1 1/2002 Bayne et al.
2002/0014268 A1 2/2002 Vann
2002/0066572 A1 6/2002 Muth

(56) References Cited

U.S. PATENT DOCUMENTS

2002/0104616 A1 8/2002 De et al.
2002/0136904 A1 9/2002 Glass et al.
2002/0162661 A1 11/2002 Krauss et al.
2003/0037925 A1 2/2003 Walker et al.
2003/0060374 A1 3/2003 Cooke, Jr.
2003/0075326 A1 4/2003 Ebinger
2003/0104147 A1 6/2003 Bretschneider et al.
2003/0111728 A1 6/2003 Thai et al.
2003/0127013 A1 7/2003 Zavitsanos et al.
2003/0141060 A1 7/2003 Hailey et al.
2003/0141061 A1 7/2003 Hailey et al.
2003/0141079 A1 7/2003 Doane et al.
2003/0150614 A1 8/2003 Brown et al.
2003/0155114 A1 8/2003 Pedersen et al.
2003/0155115 A1 8/2003 Pedersen et al.
2003/0159828 A1 8/2003 Howard et al.
2003/0164237 A1 9/2003 Butterfield
2003/0183391 A1 10/2003 Hriscu et al.
2004/0005483 A1 1/2004 Lin
2004/0020832 A1 2/2004 Richards et al.
2004/0045723 A1 3/2004 Slup et al.
2004/0089449 A1 5/2004 Walton et al.
2004/0154806 A1 8/2004 Bode et al.
2004/0159428 A1 8/2004 Hammond et al.
2004/0182583 A1 9/2004 Doane et al.
2004/0231845 A1 11/2004 Cooke, Jr.
2004/0256109 A1 12/2004 Johnson
2004/0256157 A1 12/2004 Tessari et al.
2004/0261993 A1 12/2004 Nguyen
2005/0034876 A1 2/2005 Doane et al.
2005/0051329 A1 3/2005 Blaisdell
2005/0064247 A1 3/2005 Sane et al.
2005/0069449 A1 3/2005 Jackson et al.
2005/0102255 A1 5/2005 Bultman
2005/0126334 A1 6/2005 Mirchandani
2005/0161212 A1 7/2005 Leismer et al.
2005/0161224 A1 7/2005 Starr et al.
2005/0165149 A1 7/2005 Chanak et al.
2005/0194143 A1 9/2005 Xu et al.
2005/0205264 A1 9/2005 Starr et al.
2005/0205265 A1 9/2005 Todd et al.
2005/0205266 A1 9/2005 Todd et al.
2005/0241824 A1 11/2005 Burris, II et al.
2005/0241825 A1 11/2005 Burris et al.
2005/0257936 A1 11/2005 Lehr
2005/0279501 A1 12/2005 Surjaatmadja et al.
2006/0012087 A1 1/2006 Matsuda et al.
2006/0045787 A1 3/2006 Jandeska, Jr. et al.
2006/0057479 A1 3/2006 Niimi et al.
2006/0081378 A1 4/2006 Howard et al.
2006/0102871 A1 5/2006 Wang
2006/0108114 A1 5/2006 Johnson et al.
2006/0108126 A1 5/2006 Horn et al.
2006/0110615 A1 5/2006 Karim et al.
2006/0116696 A1 6/2006 Odermatt et al.
2006/0124310 A1 6/2006 Lopez De Cardenas et al.
2006/0124312 A1 6/2006 Rytlewski et al.
2006/0131011 A1 6/2006 Lynde et al.
2006/0131031 A1 6/2006 McKeachnie et al.
2006/0131081 A1 6/2006 Mirchandani et al.
2006/0144515 A1 7/2006 Tada et al.
2006/0150770 A1 7/2006 Freim
2006/0151178 A1 7/2006 Howard et al.
2006/0162927 A1 7/2006 Walker et al.
2006/0169453 A1 8/2006 Savery et al.
2006/0207763 A1 9/2006 Hofman et al.
2006/0213670 A1 9/2006 Bishop et al.
2006/0231253 A1 10/2006 Vilela et al.
2006/0283592 A1 12/2006 Sierra et al.
2007/0017674 A1 1/2007 Blaisdell
2007/0017675 A1 1/2007 Hammami
2007/0029082 A1 2/2007 Giroux et al.
2007/0039741 A1 2/2007 Hailey
2007/0044958 A1 3/2007 Rytlewski et al.
2007/0044966 A1 3/2007 Davies et al.
2007/0051521 A1 3/2007 Fike et al.
2007/0053785 A1 3/2007 Hetz et al.
2007/0054101 A1 3/2007 Sigalas et al.
2007/0057415 A1 3/2007 Katagiri et al.
2007/0062644 A1 3/2007 Nakamura et al.
2007/0074601 A1 4/2007 Hong et al.
2007/0074873 A1 4/2007 McKeachnie et al.
2007/0102199 A1 5/2007 Smith et al.
2007/0107899 A1 5/2007 Werner et al.
2007/0107908 A1 5/2007 Vaidya et al.
2007/0108060 A1 5/2007 Park
2007/0119600 A1 5/2007 Slup et al.
2007/0131912 A1 6/2007 Simone et al.
2007/0151009 A1 7/2007 Conrad, II et al.
2007/0151769 A1 7/2007 Slutz et al.
2007/0169935 A1 7/2007 Akbar et al.
2007/0181224 A1 8/2007 Marya et al.
2007/0185655 A1 8/2007 Le Bemadjiel
2007/0187095 A1 8/2007 Walker et al.
2007/0221373 A1 9/2007 Murray
2007/0221384 A1 9/2007 Murray
2007/0259994 A1 11/2007 Tour et al.
2007/0261862 A1 11/2007 Murray
2007/0272411 A1 11/2007 Lopez De Cardenas et al.
2007/0272413 A1 11/2007 Rytlewski et al.
2007/0277979 A1 12/2007 Todd et al.
2007/0284109 A1 12/2007 East et al.
2007/0299510 A1 12/2007 Venkatraman et al.
2008/0020923 A1 1/2008 Debe et al.
2008/0047707 A1 2/2008 Boney et al.
2008/0060810 A9 3/2008 Nguyen et al.
2008/0066923 A1 3/2008 Xu
2008/0066924 A1 3/2008 Xu
2008/0072705 A1 3/2008 Chaumonnot et al.
2008/0078553 A1 4/2008 George
2008/0081866 A1 4/2008 Gong et al.
2008/0099209 A1 5/2008 Loretz et al.
2008/0105438 A1 5/2008 Jordan et al.
2008/0115932 A1 5/2008 Cooke
2008/0121390 A1 5/2008 O'Malley et al.
2008/0121436 A1 5/2008 Slay et al.
2008/0127475 A1 6/2008 Griffo
2008/0135249 A1 6/2008 Fripp et al.
2008/0149325 A1 6/2008 Crawford
2008/0149345 A1 6/2008 Marya et al.
2008/0149351 A1 6/2008 Marya et al.
2008/0169105 A1 7/2008 Williamson et al.
2008/0179060 A1 7/2008 Surjaatmadja et al.
2008/0179104 A1 7/2008 Zhang et al.
2008/0202764 A1 8/2008 Clayton et al.
2008/0202814 A1 8/2008 Lyons et al.
2008/0210473 A1 9/2008 Zhang et al.
2008/0216383 A1 9/2008 Pierick et al.
2008/0223586 A1 9/2008 Barnett
2008/0223587 A1 9/2008 Cherewyk
2008/0236829 A1 10/2008 Lynde
2008/0248205 A1 10/2008 Blanchet et al.
2008/0277109 A1 11/2008 Vaidya
2008/0277980 A1 11/2008 Koda et al.
2008/0282924 A1 11/2008 Saenger et al.
2008/0296024 A1 12/2008 Huang et al.
2008/0314581 A1 12/2008 Brown
2008/0314588 A1 12/2008 Langlais et al.
2009/0038858 A1 2/2009 Griffo et al.
2009/0044946 A1 2/2009 Schasteen et al.
2009/0044949 A1 2/2009 King et al.
2009/0050334 A1 2/2009 Marya et al.
2009/0056934 A1 3/2009 Xu
2009/0084553 A1 4/2009 Rytlewski et al.
2009/0084556 A1 4/2009 Richards et al.
2009/0084600 A1 4/2009 Severance
2009/0107684 A1 4/2009 Cooke, Jr.
2009/0114382 A1 5/2009 Grove et al.
2009/0145666 A1 6/2009 Radford et al.
2009/0151949 A1 6/2009 Marya et al.
2009/0152009 A1 6/2009 Slay et al.
2009/0159289 A1 6/2009 Avant et al.
2009/0178808 A1 7/2009 Williamson et al.
2009/0194273 A1 8/2009 Surjaatmadja et al.

(56) References Cited

U.S. PATENT DOCUMENTS

| | | | |
|---|---|---|---|
| 2009/0205841 | A1 | 8/2009 | Kluge et al. |
| 2009/0226340 | A1 | 9/2009 | Marya |
| 2009/0226704 | A1 | 9/2009 | Kauppinen et al. |
| 2009/0242202 | A1 | 10/2009 | Rispler et al. |
| 2009/0242208 | A1 | 10/2009 | Bolding |
| 2009/0242214 | A1 | 10/2009 | Foster et al. |
| 2009/0255667 | A1 | 10/2009 | Clem et al. |
| 2009/0255684 | A1 | 10/2009 | Bolding |
| 2009/0255686 | A1 | 10/2009 | Richard |
| 2009/0260817 | A1 | 10/2009 | Gambier et al. |
| 2009/0266548 | A1 | 10/2009 | Olsen et al. |
| 2009/0272544 | A1 | 11/2009 | Giroux et al. |
| 2009/0283270 | A1 | 11/2009 | Langeslag |
| 2009/0293672 | A1 | 12/2009 | Mirchandani et al. |
| 2009/0301730 | A1 | 12/2009 | Gweily |
| 2009/0308588 | A1 | 12/2009 | Howell et al. |
| 2009/0317556 | A1 | 12/2009 | Macary |
| 2010/0003536 | A1 | 1/2010 | Smith et al. |
| 2010/0012385 | A1 | 1/2010 | Drivdahl et al. |
| 2010/0015002 | A1 | 1/2010 | Barrera et al. |
| 2010/0025255 | A1 | 2/2010 | Su et al. |
| 2010/0032151 | A1 | 2/2010 | Duphorne et al. |
| 2010/0044041 | A1 | 2/2010 | Smith et al. |
| 2010/0051278 | A1 | 3/2010 | Mytopher et al. |
| 2010/0055491 | A1 | 3/2010 | Vecchio et al. |
| 2010/0055492 | A1 | 3/2010 | Barsoum et al. |
| 2010/0089583 | A1 | 4/2010 | Xu et al. |
| 2010/0089587 | A1 | 4/2010 | Stout |
| 2010/0101803 | A1 | 4/2010 | Clayton et al. |
| 2010/0122817 | A1 | 5/2010 | Surjaatmadja et al. |
| 2010/0139930 | A1 | 6/2010 | Patel et al. |
| 2010/0200230 | A1 | 8/2010 | East, Jr. et al. |
| 2010/0236793 | A1 | 9/2010 | Bjorgum |
| 2010/0236794 | A1 | 9/2010 | Duan et al. |
| 2010/0243254 | A1 | 9/2010 | Murphy et al. |
| 2010/0252273 | A1 | 10/2010 | Duphorne |
| 2010/0252280 | A1 | 10/2010 | Swor et al. |
| 2010/0270031 | A1 | 10/2010 | Patel |
| 2010/0276136 | A1 | 11/2010 | Evans et al. |
| 2010/0282338 | A1 | 11/2010 | Gerrard et al. |
| 2010/0282469 | A1 | 11/2010 | Richard et al. |
| 2010/0294510 | A1 | 11/2010 | Holmes |
| 2011/0005773 | A1 | 1/2011 | Dusterhoft et al. |
| 2011/0036592 | A1 | 2/2011 | Fay |
| 2011/0048743 | A1 | 3/2011 | Stafford et al. |
| 2011/0056692 | A1 | 3/2011 | Lopez De Cardenas et al. |
| 2011/0056702 | A1 | 3/2011 | Sharma et al. |
| 2011/0067872 | A1 | 3/2011 | Agrawal |
| 2011/0067889 | A1 | 3/2011 | Marya et al. |
| 2011/0067890 | A1 | 3/2011 | Themig |
| 2011/0094406 | A1 | 4/2011 | Marya et al. |
| 2011/0100643 | A1 | 5/2011 | Themig et al. |
| 2011/0127044 | A1 | 6/2011 | Radford et al. |
| 2011/0132143 | A1 | 6/2011 | Xu et al. |
| 2011/0132612 | A1 | 6/2011 | Agrawal et al. |
| 2011/0132619 | A1 | 6/2011 | Agrawal et al. |
| 2011/0132620 | A1 | 6/2011 | Agrawal et al. |
| 2011/0132621 | A1 | 6/2011 | Agrawal et al. |
| 2011/0135530 | A1 | 6/2011 | Xu et al. |
| 2011/0135805 | A1 | 6/2011 | Doucet et al. |
| 2011/0135953 | A1 | 6/2011 | Xu et al. |
| 2011/0136707 | A1 | 6/2011 | Xu et al. |
| 2011/0139465 | A1 | 6/2011 | Tibbles et al. |
| 2011/0147014 | A1 | 6/2011 | Chen et al. |
| 2011/0186306 | A1 | 8/2011 | Marya et al. |
| 2011/0214881 | A1 | 9/2011 | Newton |
| 2011/0247833 | A1 | 10/2011 | Todd et al. |
| 2011/0253387 | A1 | 10/2011 | Ervin |
| 2011/0256356 | A1 | 10/2011 | Tomantschger et al. |
| 2011/0259610 | A1 | 10/2011 | Shkurti et al. |
| 2011/0277987 | A1 | 11/2011 | Frazier |
| 2011/0277989 | A1 | 11/2011 | Frazier |
| 2011/0284232 | A1 | 11/2011 | Huang |
| 2011/0284240 | A1 | 11/2011 | Chen et al. |
| 2011/0284243 | A1 | 11/2011 | Frazier |
| 2012/0067426 | A1 | 3/2012 | Soni et al. |
| 2012/0103135 | A1 | 5/2012 | Xu et al. |
| 2012/0107590 | A1 | 5/2012 | Xu et al. |
| 2012/0118583 | A1 | 5/2012 | Johnson et al. |
| 2012/0130470 | A1 | 5/2012 | Agnew |
| 2012/0168152 | A1 | 7/2012 | Casciaro et al. |
| 2012/0211239 | A1 | 8/2012 | Kritzler et al. |
| 2012/0292053 | A1 | 11/2012 | Xu et al. |
| 2012/0318513 | A1 | 12/2012 | Mazyar et al. |
| 2013/0025409 | A1 | 1/2013 | Xu |
| 2013/0032357 | A1 | 2/2013 | Mazyar et al. |
| 2013/0048304 | A1 | 2/2013 | Agrawal et al. |
| 2013/0052472 | A1 | 2/2013 | Xu |
| 2013/0081814 | A1 | 4/2013 | Gaudette et al. |
| 2013/0105159 | A1 | 5/2013 | Alvarez |
| 2013/0126190 | A1 | 5/2013 | Mazyar et al. |
| 2013/0133897 | A1 | 5/2013 | Baihly et al. |
| 2013/0146144 | A1 | 6/2013 | Joseph et al. |
| 2013/0146302 | A1 | 6/2013 | Gaudette et al. |
| 2013/0186626 | A1 | 7/2013 | Aitken et al. |
| 2013/0327540 | A1 | 12/2013 | Hamid et al. |
| 2014/0116711 | A1 | 5/2014 | Tang et al. |

FOREIGN PATENT DOCUMENTS

| | | | |
|---|---|---|---|
| CN | 1076968 | A | 10/1993 |
| CN | 1255879 | A | 6/2000 |
| CN | 101050417 | A | 10/2007 |
| CN | 101351523 | A | 1/2009 |
| CN | 101457321 | A | 6/2009 |
| EP | 1798301 | A1 | 8/2006 |
| EP | 1857570 | A2 | 11/2007 |
| GB | 912956 | | 12/1962 |
| JP | 61067770 | | 4/1986 |
| JP | 754008 | A | 2/1995 |
| JP | 8232029 | A | 9/1996 |
| JP | 2000185725 | A1 | 7/2000 |
| JP | 2004225084 | A | 8/2004 |
| JP | 2004225765 | A | 8/2004 |
| JP | 2005076052 | A | 3/2005 |
| JP | 2010502840 | A | 1/2010 |
| KR | 950014350 | B1 | 11/1995 |
| WO | 9947726 | | 9/1999 |
| WO | 2008057045 | A1 | 5/2008 |
| WO | 2008079485 | A2 | 7/2008 |
| WO | 2008079777 | A3 | 7/2008 |
| WO | 2009079745 | A1 | 7/2009 |
| WO | 2011071902 | A2 | 6/2011 |
| WO | 2011071910 | A3 | 6/2011 |
| WO | 2012174101 | A2 | 12/2012 |
| WO | 2013078031 | A1 | 5/2013 |

OTHER PUBLICATIONS

W. Walters, P. Peregino, R. Summers, and D. Leidel; "A Study of Jets from Unsintered-Powder Metal Lined Nonprecision Small-Caliber Shaped Charges", Army Research Laboratory, Aberdeen Proving Ground, MD 21005-5066; Feb. 2001.

International Search Report and Written Opinion of the International Searching Authority mailed on Feb. 15, 2013 for International App. No. PCT/US2012/053339 filed on Aug. 31, 2012.

International Search Report and Written Opinion of the International Searching Authority mailed on Feb. 25, 2013 for International application No. PCT/US2012/053350 filed on Aug. 31, 2012.

"Reactivity series", Wikipedia, http://en.wikipedia.org/w/index.php?title=Reactivity_series&printable=yes downloaded on May 18, 2014. 8 pages.

"Sliding Sleeve", Omega Completion Technology Ltd, Sep. 29, 2009, retrieved on: www.omega-completion.com.

Adams, et al.; "Thermal stabilities of aromatic acids as geothermal tracers", Geothermics, vol. 21, No. 3, 1992, pp. 323-339.

Ayman, et al.; "Effect of Consolidation and Extrusion Temperatures on Tensile Properties of Hot Extruded ZK61 Magnesium Alloy Gas Atomized Powders via Spark Plasma Sintering", Transactions of JWRI, vol. 38 (2009), No. 2, pp. 1-5.

Birbilis, et al., "Exploring Corrosion Protection of Mg Via Ionic Liquid Pretreatment", Surface & Coatings Technology; 201, pp. 4496-4504, (2007).

(56) References Cited

OTHER PUBLICATIONS

Feng, et al., "Electroless Plating of Carbon Nanotubes with Silver" Journal of Materials Science, 39, (2004) pp. 3241-3243.
International Search Report and Written Opinion; International Application No. PCT/US2010/057763; International Filing Date: Nov. 23, 2010; Date of Mailing: Jul. 28, 2011; 10 pages.
International Search Report and Written Opinion; International Application No. PCT/US2010/059257; International Filing Date: Dec. 7, 2010; Date of Mailing: Jul. 27, 2011; 8 pages.
International Search Report and Written Opinion; International Application No. PCT/US2010/059259; International Filing Date: Dec. 7, 2010; Date of Mailing: Jun. 13, 2011; 8 pages.
International Search Report and Written Opinion; International Application No. PCT/US2010/059263; International Filing Date: Dec. 7, 2010; Date of Mailing: Jul. 8, 2011; 9 pages.
International Search Report and Written Opinion; International Application No. PCT/US2010/059265; International Filing Date: Dec. 7, 2010; Date of Mailing: Jun. 16, 2011; 8 pages.
International Search Report and Written Opinion; International Application No. PCT/US2010/059268; International Filing Date: Dec. 7, 2010; Date of Mailing: Jun. 17, 2011; 8 pages.
International Search Report and Written Opinion; International Application No. PCT/US2011/043036; International Filing Date: Jul. 6, 2011; Date of Mailing: Feb. 23, 2012; 9 pages.
International Search Report and Written Opinion; International Application No. PCT/US2011/047000; International Filing Date: Aug. 9, 2011; Date of Mailing: Dec. 26, 2011; 8 pages.
International Search Report and Written Opinion; International Application No. PCT/US2011/058099; International Filing Date: Oct. 27, 2011; Date of Mailing: May 11, 2012; 12 pages.
International Search Report and Written Opinion; International Application No. PCT/US2011/058105; International Filing Date: Oct. 27, 2011; Date of Mailing: May 1, 2012; 8 pages.
International Search Report and Written Opinion; International Application No. PCT/US2012/034973; International Filing Date: Apr. 25, 2012; Date of Mailing: Nov. 29, 2012; 8 pages.
International Search Report and Written Opinion; International Application No. PCT/US2012/034978; International Filing Date: Apr. 25, 2012; Date of Mailing: Nov. 12, 2012; 9 pages.
International Search Report and Written Opinion; International Application No. PCT/US2012/038622; International Filing Date: May 18, 2012; Date of Mailing: Dec. 6, 2012; 12 pages.
International Search Report and Written Opinion; International Application No. PCT/US2012/044866; International Filing Date: Jun. 29, 2012; Date of Mailing: Jan. 2, 2013; 9 pages.
International Search Report and Written Opinion; International Application No. PCT/US2012/046231; International Filing Date: Jul. 11, 2012; Date of Mailing: Jan. 29, 2013; 9 pages.
International Search Report and Written Opinion; International Application No. PCT/US2012/049434; International Filing Date: Aug. 3, 2012; Date of Mailing: Feb. 1, 2013; 7 pages.
International Search Report and Written Opinion; International Application No. PCT/US2014/049347; International Filing Date: Aug. 1, 2014; Date of Mailing: Nov. 24, 2014; 11 pages.
International Search Report and Written Opinion; International Application No. PCT/US2014/054720; International Filing Date: Sep. 9, 2014; Date of Mailing: Dec. 17, 2014; 10 pages.
Lee, et al., "Effects of Ni addition on hydrogen storage properties of Mg17AL12 alloy", Materials Chemistry and Physics, 2011, 126, pp. 319-324.
Li, et al., "Investigation of aluminium-based nancompsoites with ultra-high strength", Materials Science and Engineering A, 527, pp. 305-316, (2009).
Pardo, et al.; "Corrosion Behaviour of Magnesium/Aluminium Alloys in 3.5 wt% NaC1"; Corrosion Science; 50; pp. 823-834; (2008).
Rose, et al.; "The application of the polyaromatic sulfonates as tracers in geothermal reservoirs", Geothermics 30 (2001) pp. 617-640.
Shaw, "Benefits and Application of a Surface-Controlled Sliding Sleeve for Fracturing Operations"; Society of Petroleum Engineers, SPE Paper No. 147546; Oct. 30, 2011; 8 pages.
Shi, et al.; "Influence of the Beta Phase on the Corrosion Performance of Anodised Coatings on Magnesium-Aluminium Alloys"; Corrosion Science; 47; pp. 2760-2777; (2005).
Shigematsu, et al., "Surface Treatment of AZ91D Magnesium Alloy by Aluminum diffusion Coating", Journal of Materials Science Letters 19, 2000, pp. 473-475.
Shimizu, et al., "Multi-walled carbon nanotube-reinforced magnesium alloy composites", Scripta Materialia, vol. 58, Issue 4, Feb. 2008, pp. 267-270.
Shumbera, et al. "Improved Water Injector Performance in a Gulf of Mexico Deepwater Development Using an Openhole Frac Pack Completion and Downhole Filter System: Case History." SPE Annual Technical Conference and Exhibition, Oct. 5-8, 2003.
Singh, et al., "Extended Homogeneity Range of Intermetallic Phases in Mechanically Alloyed Mg-Al Alloys", Elsevier Sciences Ltd., Intemetallics 11, 2003, pp. 373-376.
Song, "Recent Progress in Corrosion and Protection of Magnesium Alloys"; Advanced Engineering Materials; 7(7); pp. 563-586; (2005).
Song, et al.; "A Possible Biodegradable Magnesium Implant Material," Advanced Engineering Materials, vol. 9, Issue 4, Apr. 2007, pp. 298-302.
Song, et al.; "Corrosion Behaviour of AZ21, AZ501 and AZ91 in Sodium Chloride"; Corrosion Science; 40(10); pp. 1769-1791; (1998).
Song, et al.; "Corrosion Mechanisms of Magnesium Alloys"; Advanced Engineering Materials; 1(1); pp. 11-33; (1999).
Song, et al.; "Influence of Microstructure on the Corrosion of Diecast AZ91D"; Corrosion Science; 41; pp. 249-273; (1999).
Song, et al.; "Understanding Magnesium Corrosion"; Advanced Engineering Materials; 5; No. 12; pp. 837-858; (2003).
Stanley, et al.; "An Introduction to Ground-Water Tracers", Department of Hydrology and Water Resources, University of Arizona, Mar. 1985, pp. 1-219.
Sun, et al.; "Colloidal Processing of Carbon Nanotube/Alumina Composites" Chem. Mater. 2002, 14, pp. 5169-5172.
Vickery, et al.; "New One-Trip Multi-Zone Frac Pack System with Positive Positioning." European Petroleum Conference, Oct. 29-31, 2002, Aberdeen, UK. [Abstract Only].
Xu, et al., "Nanostructured Material-Based Completion Tools Enhance Well Productivity"; International Petroleum Technology Conference; Conference Paper IPTC 16538; International Petroleum Technology Conference 2013; 4 pages.
Zemel, "Tracers in the Oil Field", University of Texas at Austin, Center for Petroleum and Geosystems, Jan. 1995, Chapters 1, 2, 3, 7.
Zeng, et al. "Progress and Challenge for Magnesium Alloys as Biomaterials," Advanced Engineering Materials, vol. 10, Issue 8, Aug. 2008, pp. B3-B14.
Zhang, et al.; "High Strength Nanostructured Materials and Their Oil Field Applications"; Society of Petroleum Engineers; Conference Paper SPE 157092; SPE International Oilfield Nanotechnology Conference, 2012; 6 pages.
Zhang, et al.; "Metal Coating on Suspended Carbon Nanotubes and its Implication to Metal—Tube Interaction", Chemical Physics Letters 331 (2000) 35-41.
"Optisleeve Sliding Sleeve", [online]; [retrieved on Jun. 25, 2010]; retrieved from the Internet weatherford.com/weatherford/groups/.../weatherfordcorp/WFT033159.pdf.
Ambat, et al., "Electroless Nickel-Plating on AZ91D Magnesium Alloy: Effect of Substrate Microstructure and Plating Parameters"; Surface and Coatings Technology; 179; pp. 124-134; (2004).
Baker Hughes, "Flow Control Systems," [online]; [retrieved on May 20, 2010]; retrieved from the Internet http://www.bakerhughes.com/products-and-services/completions-and-productions/well-completions/packers-and-flow-control/flow-control-systems.
Baker Oil Tools, "Baker Oil Tools Introduces Revolutionary Sand Control Completion Technology," May 2, 2005.
Baker Oil Tools, "Z-Seal Metal-to-Metal Expandable Sealing Device Uses Expanding Metal in Place of Elastomers," Nov. 6, 2006.

(56) References Cited

OTHER PUBLICATIONS

Bastow, et al., "Clustering and formation of nano-precipitates in dilute aluminum and magnesium alloys", Materials Science and Engineering, 2003, C23, 757-762.
Bercegeay, et al., "A One-Trip Gravel Packing System"; Society of Petroleum Engineers, Offshort Technology Conference, SPE Paper No. 4771; Feb. 7-8, 1974.
Bououdina, et al., "Comparative Study of Mechanical Alloying of (Mg+Al) and (Mg+Al+Ni) Mixtures for Hydrogen Storage", J. Alloys, Compds, 2002, 336, 222-231.
Bybee, "One-Trip Completion System Eliminates Perforations," Completions Today, Sep. 2007, pp. 52-53.
Carrejo, et al., "Improving Flow Assurance in Multi-Zone Fracturing Treatments in Hydrocarbon Reservoirs with High Strength Corrodible Tripping Balls"; Society of Petroleum Engineers; SPE Paper No. 151613; Apr. 16, 2012; 6 pages.
Chang, et al., "Electrodeposition of Aluminum on Magnesium Alloy in Aluminum Chloride (A1C13)-1-ethy1-3-methylimidazolium chloride (EMIC) Ionic Liquid and Its Corrosion Behavior"; Electrochemistry Communications; 9; pp. 1602-1606; (2007).
Christoglou, et al., "Deposition of Aluminum on Magnesium by a CVD Process", Surface and Coatings Technology 184 (2004) 149-155.
Constantine, "Selective Production of Horizontal Openhole Completions Using ECP and Sliding Sleeve Technology." SPE Rocky Mountain Regional Meeting, May 15-19, 1999, Gillette, Wyoming. [Abstract Only].
Curtin, et al., "CNT-reinforced ceramics and metals," Materials Today, 2004, vol. 7, pp. 44-49.
Flahaut, et al., "Carbon Nanotube-Metal-Oxide Nanocomposites: Microstructure, Electrical Conductivity and Mechanical Properties" Acta amter. 48 (2000), pp. 3803-3812.
Forsyth, et al.; "An Ionic Liquid Surface Treatment for Corrosion Protection of Magnesium Alloy AZ31"; Electrochem. Solid-State Lett./ 9(11); Abstract only; 1 page.
Galanty, et al. "Consolidation of metal powders during the extrusion process," Journal of Materials Processing Technology (2002), pp. 491-496.
Garfield, New One-Trip Sand-Control Completion System that Eliminates Formation Damage Resulting From conventional Perforating and Gravel-Packing Operations:, SPE Annual Technical Conference and Exhibition, Oct. 9-12, 2005.
Garfield, et al., "Maximizing Inflow Performance in Soft Sand Completions Using New One-trip Sand Control Liner Completion Technology", SPE European Formation Damage Conference, May 25-27, 2005.
Goh, et al., "Development of novel carbon nanotube reinforced magnesium nanocomposites using the powder metallurgy technique", Nanottechnology 17 (2006) 7-12.
Gray, et al., "Protective Coatings on Magnesium and Its Alloys—a Critical Review", Journal of Alloys and Compounds 336 (2002), pp. 88-113.
Han, et al., "Mechanical Properties of Nanostructured Materials", Rev. Adv. Mater. Sci. 9(2005) 1-16.
Hermawan, et al., "Iron-manganese: new class of metallic degradable biomaterials prepared by powder metallurgy", Powder Metallurgy, vol. 51, No. 1, (2008), pp. 38-45.
Hjortstam, et al. "Can we achieve ultra-low resistivity in carbon nanotube-based metal composites," Applied Physics A (2004), vol. 78, Issue 8, pp. 1175-1179.
Hsiao, et al., "Anodization of AZ91D Magnesium Alloy in Silicate-Containing Electrolytes"; Surface & Coatings Technology; 199; pp. 127-134; (2005).
Hsiao, et al., "Baking Treatment Effect on Materials Characteristics and Electrochemical Behavior of anodic Film Formed on AZ91D Magnesium Alloy"; Corrosion Science; 49; pp. 781-793; (2007).
Hsiao, et al., "Characterization of Anodic Films Formed on AZ91D Magnesium Alloy"; Surface & Coatings Technology; 190; pp. 299-308; (2005).
Hsiao, et al., "Effect of Heat Treatment on Anodization and Electrochemical Behavior of AZ91D Magnesium Alloy"; J. Mater. Res.; 20(10); pp. 2763-2771;(2005).
Huo et al.; "Corrosion of AZ91D Magnesium Alloy with a Chemical Conversion Coating and Electroless Nickel Layer"; Corrosion Science: 46; pp. 1467-1477; (2004).
Kuzumaki, et al.; "Mechanical Characteristics and Preparation of Carbon Nanotube Fiber-Reinforced Ti Composite", Advanced Engineering Materials, 2000, 2, No. 7.
Lavernia, et al.,"Cryomilled Nanostructured Materials: Processing and Properties", Materials Science and Engineering A, 493, (2008) pp. 207-214.
Li, "Design of Abrasive Water Jet Perforation and Hydraulic Fracturing Tool," Oil Field Equipment, Mar. 2011.
Liu, et al., "Calculated Phase Diagrams and the Corrosion of Die-Cast Mg-Al Alloys", Corrosion Science, 2009, 51, 606-619.
Liu, et al.; "Electroless Nickel Plating on AZ91 Mg Alloy Substrate"; Surface & Coatings Technology; 200; pp. 5087-5093; (2006).
Lunder et al.; "The Role of Mg17Al12 Phase in the Corrosion of Mg Alloy AZ91"; Corrosion; 45(9); pp. 741-748; (1989).
Maisano, "Cryomilling of Aluminum-Based and Magnesium-Based Metal Powders", Thesis, Virginia Tech, Jan. 13, 2006.
Majumdar, et al., "Laser Surface Engineering of a Magnesium Alloy with Al + Al2O3", Surface and Coatings Technology 179 (2004) pp. 297-305.
Mathis, "Sand Management: A Review of Approaches and Concerns", Society of Petroleum Engineers, SPE Paper No. 82240, SPE European Formation Damage Conference, The Hague, The Netherlands, May 13-14, 2003.
Nie, "Patents of Methods to Prepare Intermetallic Matrix Composites: A Review", Recent Patents on Materials Science 2008, vol. 1, pp. 232-240.
Seyni, et al., "On the interest of using degradable fillers in co-ground composite materials", Powder Technology 190, (2009) pp. 176-184.
Vahlas, et al., "Principles and Applications of CVD Powder Technology", Materials Science and Engineering R 53 (2006) pp. 1-72.
Wang, et al., "Contact-Damage-Resistant Ceramic/Single-Wall Carbon Nanotubes and Ceramic/Graphite Composites" Nature Materials, vol. 3, Aug. 2004, pp. 539-544.
Watanabe, et al., "Superplastic Deformation Mechanism in Powder Metallurgy Magnesium Alloys and Composites", Acta mater. 49 (2001) pp. 2027-2037.
Watarai, Trend of research and development for magnesium alloys—reducing the weight of structural materials in motor vehicles, (2006) Science and technology trends, Quaterly review No. 18, 84-97.
Welch, et al., "Nonelastomeric Sliding Sleeve Maintains Long Term Integrity in HP/HT Application: Case Histories" [Abstract Only], SPE Eastern Regional Meeting, Oct. 23-25, 1996, Columbus. Ohio.
Zhan, et al., "Single-wall carbon nanotubes as attractive toughening agents in alumina-based nanocomposites" Nature Materials, vol. 2., Jan. 2003, pp. 38-42.
Zhang, et al.; "Formation of metal nanowires on suspended single-walled carbon nanotubes" Applied Physics Letter, vol. 77, No. 19 (2000), pp. 3015-3017.
Zhang, et al.; "Study on the Environmentally Friendly Anodizing of AZ91D Magnesium Alloy"; Surface and Coatings Technology: 161; pp. 36-43; (2002).
Zhu, et al., "The process of coating on ultrafine particles by surface hydrolysis reaction in a fluidized bed reactor", Surface and Coatings Technology 135 (2000) 14-17.

METHOD OF USING A DEGRADABLE SHAPED CHARGE AND PERFORATING GUN SYSTEM

CROSS REFERENCE TO RELATED APPLICATIONS

This application contains subject matter related to the subject matter of co-pending applications, which are assigned to the same assignee as this application, Baker Hughes Incorporated of Houston, Tex. and are all being filed on the same date as this application. The below listed applications are hereby incorporated by reference in their entirety:

U.S. patent application Ser. No. 13/225,413 entitled "Degradable High Shock Impedance Material," and U.S. patent application Ser. No. 13/225,414 entitled "Degradable Shaped Charge and Perforating Gun System."

BACKGROUND

To complete a well, one or more formation zones adjacent a wellbore are perforated to allow fluid from the formation zones to flow into the well for production to the surface or to allow injection fluids to be applied into the formation zones. Perforating systems are used for the purpose, among others, of making hydraulic communication passages, called perforations, in wellbores drilled through earth formations so that predetermined zones of the earth formations can be hydraulically connected to the wellbore. Perforations are needed because wellbores are typically completed by coaxially inserting a pipe or casing into the wellbore. The casing is retained in the wellbore by pumping cement into the annular space between the wellbore and the casing to line the wellbore. The cemented casing is provided in the wellbore for the specific purpose of hydraulically isolating from each other the various earth formations penetrated by the wellbore.

Perforating systems typically comprise one or more shaped charge perforating guns strung together. A perforating gun string may be lowered into the well and one or more guns fired to create openings in the casing and/or a cement liner and to extend perforations into the surrounding formation.

Shaped charge guns known in the art for perforating wellbores typically include a shaped charge liner. A high explosive is detonated to collapse the liner and ejects it from one end of the shaped charge at a very high velocity in a pattern called a "jet". The jet penetrates and perforates the casing, the cement and a quantity of the earth formation. In order to provide perforations which have efficient hydraulic communication with the formation, it is known in the art to design shaped charges in various ways to provide a jet which can penetrate a large quantity of formation, the quantity usually referred to as the "penetration depth" of the perforation. The jet from the metal liners also may leave a residue in the resulting perforation, thereby reducing the efficiency and productivity of the well.

Furthermore, once a shape charge gun has been fired, in addition to addressing the issues regarding the residual liner material left in the perforation, the components other than the liner must generally also be removed from the wellbore, which generally require additional costly and time consuming removal operations.

Therefore, perforation systems and methods of using them that incorporate liners and other components formed from materials that may be selectively removed from the wellbore are very desirable.

SUMMARY

In an exemplary embodiment, a method for perforating a formation interval in a well is disclosed. The method includes disposing a perforation gun comprising a shaped charge in the well proximate the formation interval, wherein the shaped charge comprises a charge case having a charge cavity, a liner disposed within the charge cavity and an explosive disposed within the charge cavity between the liner and the charge case, wherein the charge case and liner are each formed from a selectively corrodible powder compact material. The method also includes detonating the shaped charge to form a perforation tunnel in the formation interval and deposit a liner residue in the perforation tunnel The method further includes exposing the perforation gun and perforation tunnel to a predetermined wellbore fluid after detonating the shaped charge to remove a liner residue from the perforation tunnel and the charge case from the well.

BRIEF DESCRIPTION OF THE DRAWINGS

Referring now to the drawings wherein like elements are numbered alike in the several Figures.

DETAILED DESCRIPTION

Generally, a selectively and controllably corrodible perforating system and method of using the perforating system for perforating a wellbore, either cased or open (i.e., uncased) is disclosed, as well as powder compact material compositions that may be used to form the various components of the selectively corrodible perforating system, particularly powder compacts comprising a cellular nanomatrix having a plurality particles of a particle core material dispersed therein. The selectively corrodible materials described herein may be corroded, dissolved or otherwise removed from the wellbore as described herein in response to a predetermined wellbore condition, such as exposure of the materials to a predetermined wellbore fluid, such as an acid, a fracturing fluid, an injection fluid, or a completions fluid, as described herein.

Figure 1:
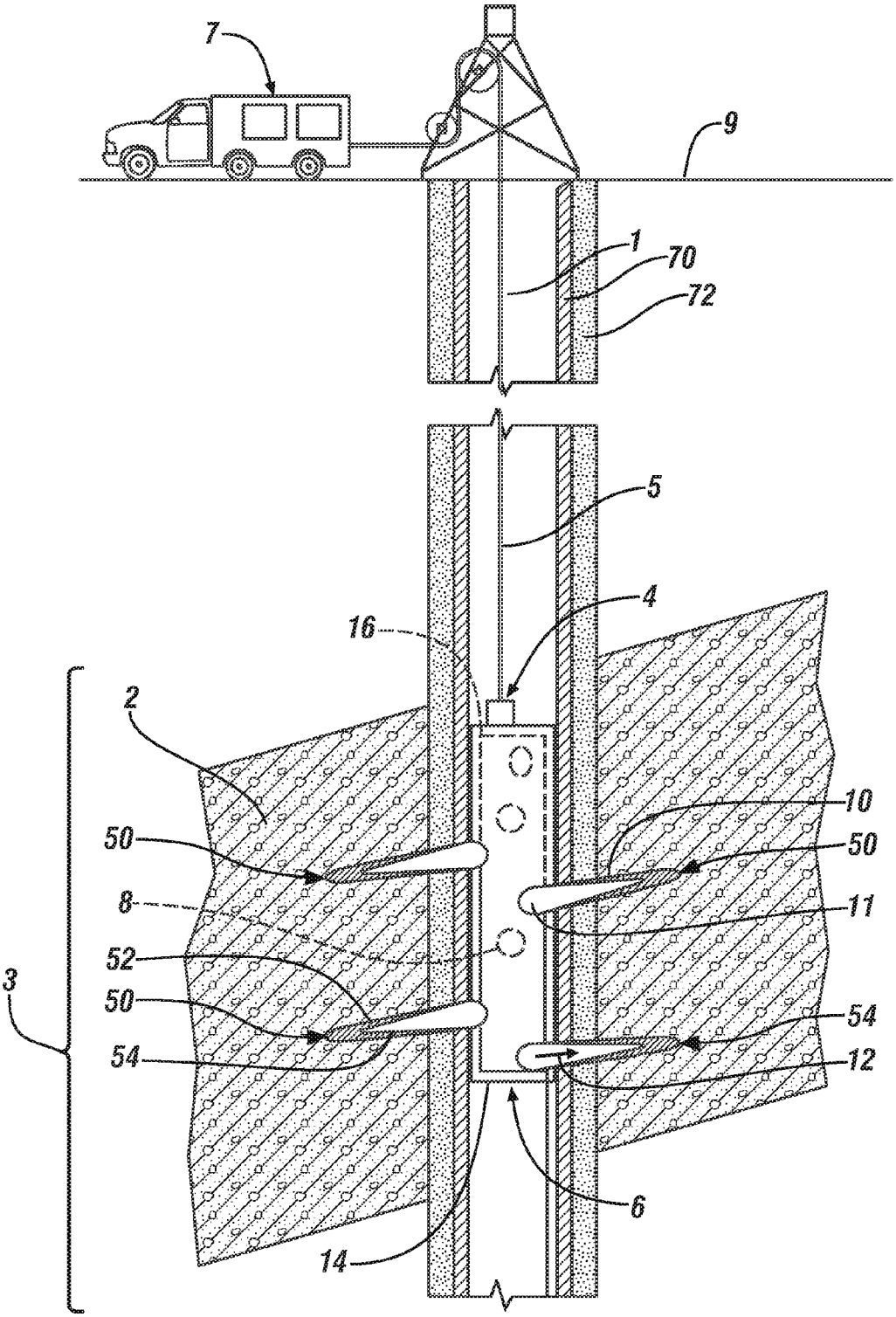
FIG. 1 is a partial cutaway view of an exemplary embodiment of a perforating system and method of using the same as disclosed herein.

Referring to FIG. 1, after a well or wellbore 1 is drilled, a casing 70 is typically run in the wellbore 1 and cemented into the well in order to maintain well integrity. After the casing 70 has been cemented with cement 72 in the wellbore 1, one or more sections of the casing 70 that are adjacent to the formation zones 3 of interest (e.g., target well zone) may be perforated to allow fluid from the formation zone 3 to flow into the well for production to the surface or to allow injection fluids to be applied into the formation zones 3. To perforate a casing 70 section, a selectively corrodible perforating system 4 comprising a selectively corrodible perforating gun 6 string may be lowered into the wellbore 1 to the desired depth of the formation zone 3 of interest, and one or more perforation guns 6 are fired to create openings 11 in the casing 70 and to extend perforations 10 into the formation zone 3. Production fluids in the perforated formation zone 3 can then flow through the perforations 10 and the casing openings 11 into the wellbore 1, for example.

Referring again to FIG. 1, an exemplary embodiment of a selectively corrodible perforating system 4 comprises one or more selectively corrodible perforating guns 6 strung together. These strings of guns 6 can have any suitable length, including a thousand feet or more of perforating length. For purposes of illustration, the perforating system 4 depicted comprises a single selectively corrodible perforating gun 6 rather than multiple guns. The gun 6 is shown disposed within a wellbore 1 on a wireline 5. As an example, the perforating system 4 as shown also includes a service truck 7 on the surface 9, where in addition to providing a raising and lowering system for the perforating system 4, the wireline 5 also may provide communication and control system between the truck 7 and the surface generally and the perforating gun 6 in the wellbore 1. The wireline 5 may be threaded through various pulleys and supported above the wellbore 1.

Perforating guns 6 includes a gun strip or shaped charge housing 16 that is configured to house one or more shaped charges 8 and that is coaxially housed within a gun body or outer housing 14. Both shaped charge housing 16 outer housing 14 may have any suitable shape, including an annular shape, and may be formed from any suitable material, including conventional housing materials, and in an exemplary embodiment either or both may be formed from a selectively corrodible material as described herein.

In an exemplary embodiment, shaped charge housing 16 may be formed from a selectively corrodible shaped charge housing material 17 as described herein. In another exemplary embodiment, outer housing 14 may be formed from a selectively corrodible material 15. The selectively corrodible outer housing material 15 and shaped charge housing material 17 may be the same material or different materials as described herein.

Figure 2:
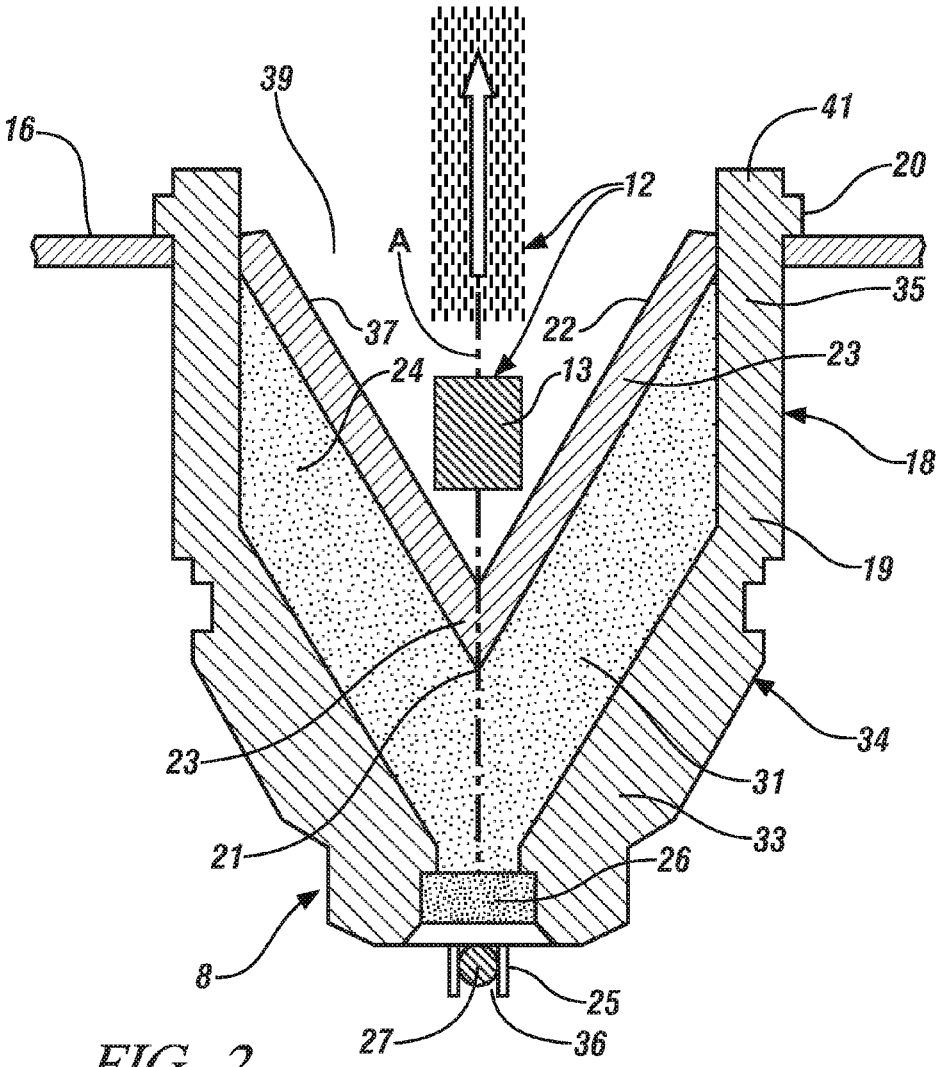
FIG. 2 is a cross-sectional view of an exemplary embodiment of a shaped charge as disclosed herein.

Shaped charges 8 are housed within the shaped charge housing 16 and aimed outwardly generally perpendicular to the axis of the wellbore 1. As illustrated in FIG. 2, in an exemplary embodiment a selectively corrodible shaped charge 8 includes a housing or charge case 18 formed from a selectively corrodible charge case material 19, a selectively corrodible shaped charge liner 22 formed from a selectively corrodible liner material 23 disposed within the charge case 18 generally axially along a longitudinal axis of the case, a quantity comprising a main charge 24 of high explosive material disposed within the charge case and deposited between the liner 22 and the charge case 18, and a booster charge 26 proximate the base of the high explosive 24 and configured for detonation of the high explosive.

Referring to FIGS. 2, a shaped charge 8 in accordance with embodiments of the present invention includes a charge case 18 that acts as a containment vessel designed to hold the detonation force of the detonating explosion long enough for a perforating jet 12 (FIGS. 1 and 2) to form. The case body 34 is a container-like structure having a bottom wall 33 section sloping upward with respect to the axis A of the charge case 18. The charge case 18 as shown is substantially symmetric about the axis A. In the embodiment shown, the charge case 18 transitions into the upper wall 35 portion where the slope of the wall steepens, including the orientation shown where the upper wall 35 is substantially parallel to the axis A. The upper portion 35 also has a profile oblique to the axis A. Extending downward from the bottom portion 33 is a cord slot 36 having a pair of tabs 25. The tabs 25 are configured to receive a detonating cord 27 therebetween and are generally parallel with the axis A of the charge case 18. A crown wall 41 portion defines the uppermost portion of the case body 34 extending from the upper terminal end of the upper portion 35. The uppermost portion of the crown portion 41 defines the opening 39 of the charge case 18 and lies in a plane that is substantially perpendicular to the axis A. A boss element 20 is provided on the outer surface of the crown portion 41. The boss 20 is an elongated member whose elongate section partially circumscribes a portion of the outer peripheral radius of the crown portion 41, and thus partially circumscribes the outer circumference of the charge case 18. In the embodiment shown, the boss 20 cross-section is substantially rectangular and extends radially outwardly from the outer surface of the charge case 18. While the charge case 8 shown is generally cylindrical, charge case 18 may have any shape suitable for housing the liner 22 and main charge 24 as described herein.

Figure 3:
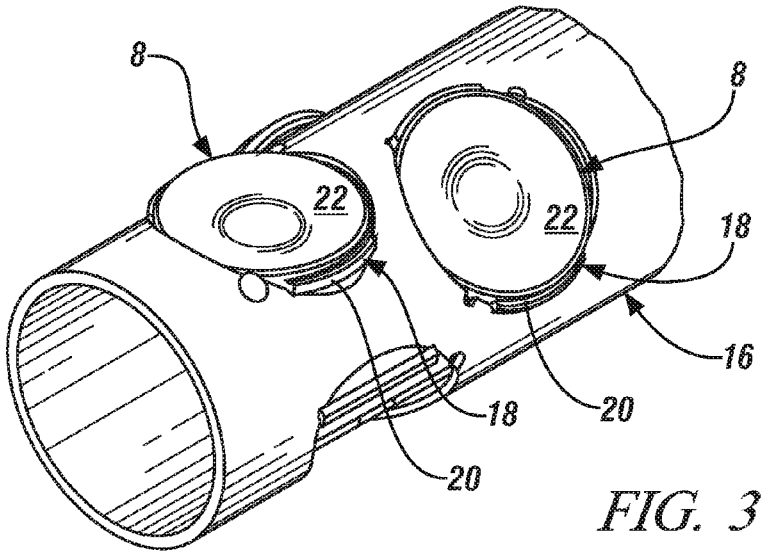
FIG. 3 is a perspective view of an exemplary embodiment of a perforating system, including shaped charges and a shaped charge housing as disclosed herein.

The shaped charges 8 may be positioned within the shaped charge housing 16 in any orientation or configuration, including a high density configuration of at least 10-12 shaped charges 8 per linear foot of perforating gun. In some instances however high density shots may include guns having as few as 6 shaped charge 8 shots per linear foot. Referring to FIG. 3, the shaped charge housing 16 provides an example of a high density configuration. The charges carried in a perforating gun 6 may be phased to fire in multiple directions around the circumference of the wellbore 1. Alternatively, the charges may be aligned in a straight line or in any predetermined firing pattern. When fired, the charges create perforating jets 12 that form openings 11 or perforations or holes in the surrounding casing 70 as well as extend perforations 10 into the surrounding formation zone 3.

Figure 4:
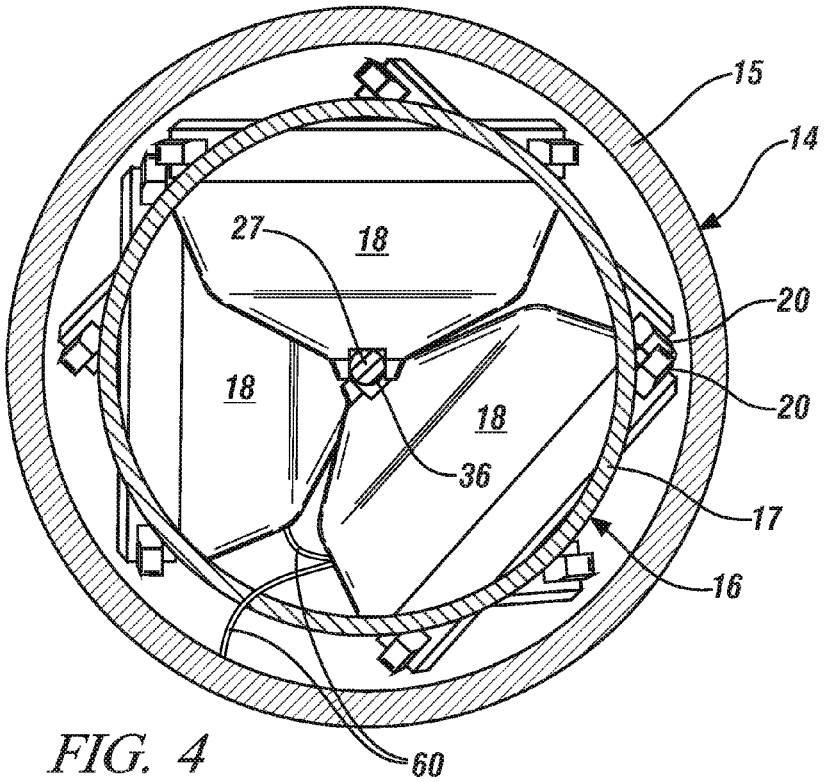
FIG. 4 is a cross-sectional view of an exemplary embodiment of a perforating system, including shaped charges, a shaped charge housing and an outer housing as disclosed herein.

FIG. 4 provides a view looking along the axis of the shaped charge housing 16 having multiple charge casings 18 disposed therein. In this view, a detonating cord 27 is shown coupled within the tabs 25 and cord slot 36 of the respective charge casings 18. The respective cord slots 36 of the charge cases 18 are aligned for receiving the detonation cord 27 therethrough. The shaped charge housing 16 is disposed within outer housing 14. As indicated the portion of outer housing 14 proximate shaped charges 8 may have the wall thickness reduced in a window, such as a generally circular window, either from the outer surface or inner surface, or both, to reduce the energy needed for the liner material to pierce through the housing and increase the energy available to penetrate the formation.

The liner 22 may have any suitable shape. In the exemplary embodiment of FIG. 2, the liner 22 is generally frustoconical in shape and is distributed substantially symmetrically about the axis A. Liner 22 generally may be described as having a sidewall 37 that defines an apex 21 and a liner opening 39. Other liner 22 shapes are also possible, including a multi-sectional liner having two or more frustoconical sections with different taper angles, such as one that opens at a first taper angle and a second taper angle that opens more rapidly that the first taper angle, a tulip-shaped liner, which as its name suggest mimics the shape of a tulip, a fully or partially (e.g., combination of a cylindrical or frustoconical sidewall and hemispherical apex) hemispherical liner, a generally frustoconical liner having a rounded or curved apex, a linear liner having a V-shaped cross section with straight wall sides or a trumpet-shaped liner having generally conically shaped with curved sidewall that curve outwardly as they extend from the apex of the liner to the liner opening. Liner 22 may be formed as described herein to provide a porous powder compact having less than full theoretical density, so that the liner 22 substantially disintegrates into a perforating jet of particles upon detonation of the main charge 24 and avoids the formation of a "carrot" or "slug" of solid material. Liner 22 may also be formed as a solid material having substantially full theoretical density and the jet 12 formed therefrom may include a carrot 13 or slug. In either case, liner 22 is formed from selectively corrodible liner material 23 and is configured for removal of residual liner material 23 from the perforations 10 as described herein.

The main charge 24 is contained inside the charge case 18 and is arranged between the inner surface 31 of the charge case and the liner 22. A booster charge 26 or primer column or other ballistic transfer element is configured for explosively coupling the main explosive charge 24 and a detonating cord 27, which is attached to an end of the shaped charge, by providing a detonating link between them. Any suitable explosives may be used for the high explosive 24, booster charge 26 and detonating cord 27. Examples of explosives that may be used in the various explosive components (e.g., charges, detonating cord, and boosters) include RDX (cyclotrimethylenetrinitramine or hexahydro-1,3,5-trinitro-1,3,5-triazine), HMX (cyclotetramethylenetetranitramine or 1,3,5,7-tetranitro-1,3,5,7-tetraazacyclooctane), TATB (triaminotrinitrobenzene), HNS (hexanitrostilbene), and others.

In an exemplary embodiment, in order to detonate the main charge 24 of shaped charge 8, a detonation wave traveling through the detonating cord 27 initiates the booster charge 26 when the detonation wave passes by, which in turn initiates detonation of the main explosive charge 24 to create a detonation wave that sweeps through the shaped charge. The liner 22 collapses under the detonation force of the main explosive charge. The shaped charges 8 are typically explosively coupled to or connected to a detonating cord 27 which is affixed to the shaped charge 8 by a case slot 25 and located proximate the booster charge 26. Detonating the detonating cord 27 creates a compressive pressure wave along its length that in turn detonates the booster charge 26 that in turn detonates the high explosive 24. When the high explosive 24 is detonated, the force of the detonation collapses the liner 22, generally pushing the apex 21 through the liner opening 39 and ejects it from one end of the shaped charge 8 at very high velocity in a pattern of the liner material that is called a perforating jet 12. The perforating jet 12 may have any suitable shape, but generally includes a high velocity pattern of fragments of the liner material on a leading edge and, particularly in the case of solid liner material 23, may also include a trailing carrot or slug comprising a substantially solid mass of the liner material. The perforating jet 12 is configured to shoot out of the open end 39 of the charge case 18 and perforate the outer housing 14, casing 70 and any cement 72 lining the wellbore 1 and create a perforation 10 in the formation 2, usually having the shape of a substantially conical or bullet-shaped funnel that tapers inwardly away from the wellbore 1 and extends into the surrounding earth formation 2. Around the surface region adjacent to the perforation 10 or tunnel, a layer of charge liner residue 50. The charge liner residue 50 includes "wall" residue 52 deposited on the wall of the perforation 10 and "tip" residue 54 deposited at the tip of the perforation. The selectively corrodible liner material 23 disclosed herein enables selective and rapid removal of the charge liner residue 50, including the wall residue 52 and tip residue 54 from the perforation in response to a predetermined wellbore condition, such as exposure of the charge liner residue 50 to a predetermined wellbore fluid of the types described herein. The removal of the charge liner residue, particularly the tip residue, is very advantageous, because it enables the unhindered flow of wellbore fluids into and out of the perforation through the tip portion, thereby increasing the productivity of the individual perforations and hence the overall productivity of the wellbore 1.

In accordance with embodiments of the present invention, the shaped charge 8 includes a liner 22 fabricated from a material that is selectively corrodible in the presence of a suitable predetermined wellbore fluid (e.g., an acid, an injection fluid, a fracturing fluid, or a completions fluid). As a result, any liner residue remaining in the perforation tunnel post-detonation (specifically, in the tip region of the tunnel) may be dissolved into the dissolving fluid and will no longer be detrimental to injection or other operations. It is significant that the material used in the charge liner be targeted to correspond with a dissolving fluid in which the liner material is soluble in presence of Perforating system 4 may also include a galvanic member 60, such as a metallic or conductive member, that is selected to promote galvanic coupling and dissolution or corrosion of the selectively corrodible members, particularly one or more of charge cases 18, shape charge housing 16 or outer housing 14.

Once the shaped charges 8 have been fired, it is also desirable to remove remaining portions of the perforating system 4 from the wellbore, particularly the shaped charge case 18, shaped charge housing 16 and outer housing 14. In an exemplary embodiment, where charge case 18 is formed from selectively corrodible charge case material 19, and one or both of shaped charge housing 16 and outer housing 14 is formed from selectively corrodible shaped charge housing material 17 and selectively corrodible outer housing material 15, respectively, the remaining portions of perforating system 4 that are formed from a selectively corrodible material may be removed from the wellbore by exposure to a predetermined wellbore fluid, as described herein. The remainder of the perforating system 4 may be selectively corroded, dissolved or otherwise removed from the wellbore at the same time as the charge liner residue 50 by exposure to the same predetermined wellbore fluid. Alternately, the remainder of perforating system 4 may be removed from the wellbore at a different time by exposure to a different predetermined wellbore fluid.

As described, the selectively corrodible materials described herein may be corroded, dissolved or otherwise removed from the wellbore as described herein in response to a predetermined wellbore condition, such as exposure of the materials to a predetermined wellbore fluid, such as an acid, a fracturing fluid, an injection fluid, or a completions fluid, as described herein. Acids that may be used to dissolve any charge liner residue in acidizing operations include, but are not limited to: hydrochloric acid, hydrofluoric acid, acetic acid, and formic acid. Fracturing fluids that may be used to dissolve any charge liner residue in fracturing operations include, but are not limited to: acids, such as hydrochloric acid and hydrofluoric acid. Injection fluids that may be pumped into the formation interval to dissolve any charge liner residue include, but are not limited to: water and seawater. Completion fluids that may be circulated proximate the formation interval to dissolve any charge liner residue include, but are not limited to, brines, such as chlorides, bromides and formates.

A method for perforating in a well include: (1) disposing a perforating gun in the well, wherein the perforating gun comprises a shaped charge having a charge case, an explosive disposed inside the charge case, and a liner for retaining the explosive in the charge case, wherein the liner includes a material that is soluble with an acid, an injection fluid, a fracturing fluid, or a completions fluid; (2) detonating the shaped charge to form a perforation tunnel in a formation zone and leaving charge liner residue within the perforating tunnel (on the well and tip); (3) performing one of the following: (i) pumping an acid downhole, (ii) pumping a fracturing fluid downhole, (iii) pumping an injection fluid downhole, or (iv) circulating a completion or wellbore fluid downhole to contact the charge liner residue in the perforation tunnel; and (4) allowing the material comprising the charge liner residue to dissolve with the acid, an injection fluid, a fracturing fluid, or a completions fluid. After such operation, a treatment fluid may be injected into the formation and/or the formation may be produced.

In an exemplary embodiment, the selectively corrodible perforating system 4 components described herein may be formed from selectively corrodible nanomatrix materials. These include: the shaped charge 8 comprising shaped charge housing 16 and shaped charge housing material 19 and liner 22 and selectively corrodible liner material 23, shaped charge housing 16 and selectively corrodible shaped charge housing material 17, and outer housing 14 and selectively corrodible outer housing material 15. The Nanomatrix materials and methods of making these materials are described generally, for example, in U.S. patent application Ser. No. 12/633,682 filed on Dec. 8, 2009 and U.S. patent application Ser. No. 13/194,361 filed on Jul. 29, 2011, which are hereby incorporated herein by reference in their entirety. These lightweight, high-strength and selectably and controllably degradable materials may range from fully-dense, sintered powder compacts to precursor or green state (less than fully dense) compacts that may be sintered or unsintered. They are formed from coated powder materials that include various lightweight particle cores and core materials having various single layer and multilayer nanoscale coatings. These powder compacts are made from coated metallic powders that include various electrochemically-active (e.g., having relatively higher standard oxidation potentials) lightweight, high-strength particle cores and core materials, such as electrochemically active metals, that are dispersed within a cellular nanomatrix formed from the consolidation of the various nanoscale metallic coating layers of metallic coating materials, and are particularly useful in wellbore applications. The powder compacts may be made by any suitable powder compaction method, including cold isostatic pressing (CIP), hot isostatic pressing (HIP), dynamic forging and extrusion, and combinations thereof. These powder compacts provide a unique and advantageous combination of mechanical strength properties, such as compression and shear strength, low density and selectable and controllable corrosion properties, particularly rapid and controlled dissolution in various wellbore fluids. The fluids may include any number of ionic fluids or highly polar fluids, such as those that contain various chlorides. Examples include fluids comprising potassium chloride (KCl), hydrochloric acid (HCl), calcium chloride ($CaCl_2$), calcium bromide ($CaBr_2$) or zinc bromide ($ZnBr_2$). The disclosure of the '682 and '361 applications regarding the nature of the coated powders and methods of making and compacting the coated powders are generally applicable to provide the selectively corrodible nanomatrix materials disclosed herein, and for brevity, are not repeated herein.

Figure 5:
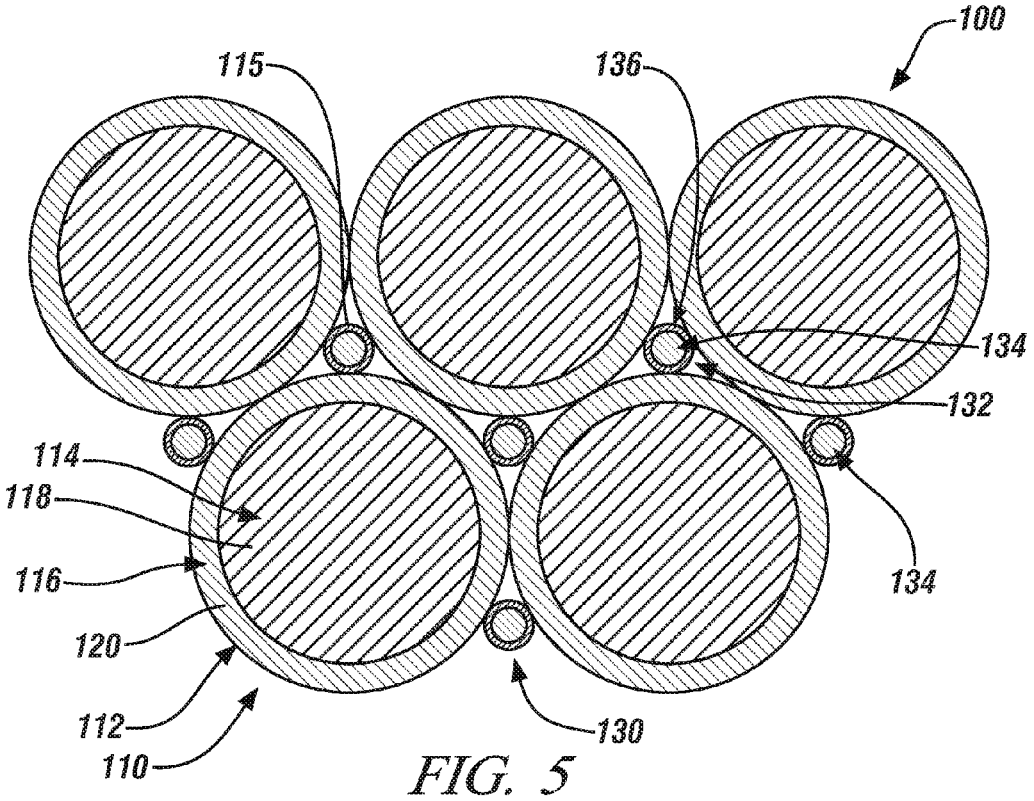
FIG. 5 is a cross-sectional view of an exemplary embodiment of a coated powder as disclosed herein.
Figure 6:
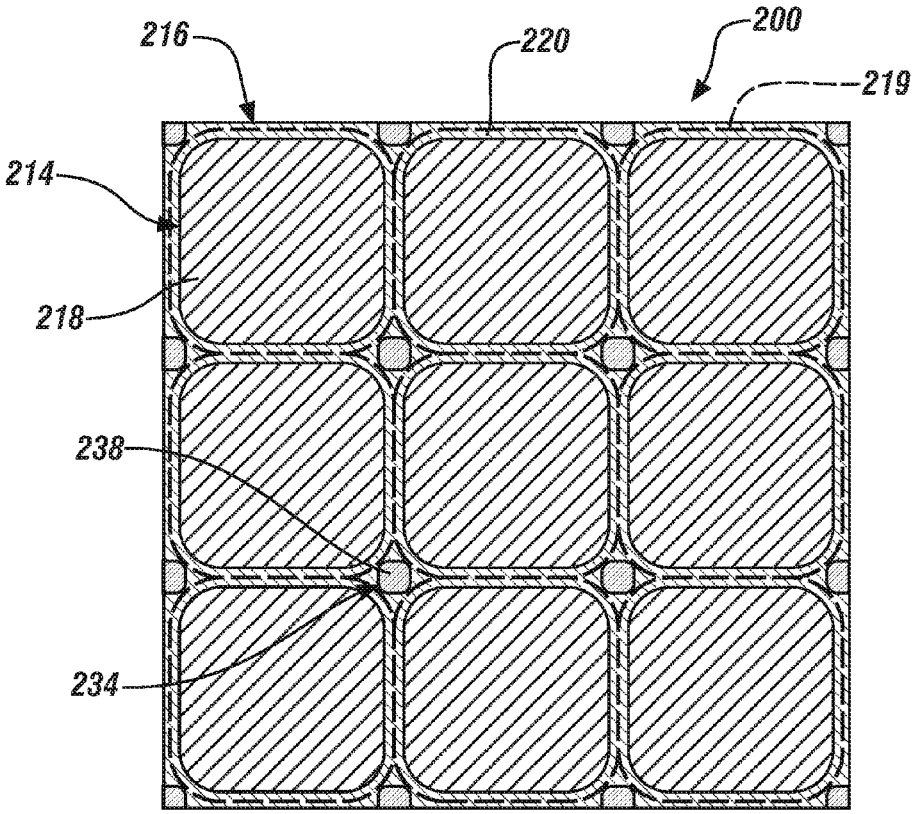
FIG. 6 is a cross-sectional view of a nanomatrix material as may be used to make a selectively corrodible perforating system as disclosed herein.

As illustrated in FIGS. 5 and 6 the selectively corrodible materials disclosed herein may be formed from a powder 100 comprising powder particles 112, including a particle core 114 and core material 118 and metallic coating layer 116 and coating material 120, may be selected that is configured for compaction and sintering to provide a powder metal compact 200 that is selectably and controllably removable from a wellbore in response to a change in a wellbore property, including being selectably and controllably dissolvable in a predetermined wellbore fluid, including various predetermined wellbore fluids as disclosed herein. The powder metal compact 200 includes a cellular nanomatrix 216 comprising a nanomatrix material 220 and a plurality of dispersed particles 214 comprising a particle core material 218 as described herein dispersed in the cellular nanomatrix 216.

As described herein, the shaped charge 8 comprising shaped charge housing 16 and shaped charge housing material 19 and liner 22 and selectively corrodible liner material 23, shaped charge housing 16 and selectively corrodible shaped charge housing material 17, and outer housing 14 and selectively corrodible outer housing material 15 may be formed from the same materials or different materials. In an exemplary embodiment, it is desirable to form the shaped charge 8, including the shaped charge housing 16 or liner 22, or both of them, from a nanomatrix material that provides a mechanical shock impedance or mechanical shock response that enables containment of the explosion by the shaped charge housing 16 and formation of jet 12 from liner 22 that is configured to penetrate various earth formations, such as, for example, materials having a high density and ductility. In another exemplary embodiment, it is desirable to form the shaped charge housing 16 or outer housing 14, or both of them, from a lightweight, high-strength material sufficient to house the shaped charges 8.

Dispersed particles 214 may comprise any of the materials described herein for particle cores 114, even though the chemical composition of dispersed particles 214 may be different due to diffusion effects as described herein. In an exemplary embodiment, the shaped charge 8, including the shaped charge housing 16 and liner 22, may include dispersed particles 214 that are formed from particle cores 114 with particle core material having a density of about 7.5 g/cm$^3$ or more, and more particularly a density of about 8.5 g/cm$^3$ or more, and even more particularly a density of about 10 g/cm$^3$ or more. More particularly, particle cores 114 may include a particle core material 118 that comprises a metal, ceramic, cermet, glass or carbon, or a composite thereof, or a combination of any of the foregoing materials. Even more particularly, particle cores 114 may include a particle core material 118 that comprises Fe, Ni, Cu, W, Mo, Ta, U or Co, or a carbide, oxide or nitride comprising at least one of the foregoing metals, or an alloy comprising at least one of the aforementioned materials, or a composite comprising at least one of the aforementioned materials, or a combination of any of the foregoing. If uranium is used, it may include depleted uranium, since it is commercially more readily available. The dispersed particles 214 may be formed from a single particle core material or multiple particle core materials. In one embodiment, dispersed particles 214 are formed from particle cores 114 that comprise up to about 50 volume percent of an Mg—Al alloy, such as an alloy of Mg-10 wt. % Al, and about 50 volume percent or more of a W—Al alloy, such as an alloy of W-10 wt. % Al. In another embodiment, dispersed particles 214 are formed from particle cores 114 that comprise up to about 50 volume percent of an Mg—Al alloy, such as an alloy of Mg-10 wt. % Al, and about 50 volume percent or more of a Zn—Al alloy, such as an alloy of Zn-10 wt. % Al. In yet another embodiment, dispersed particles 214 are formed from particle cores 114 that comprise up to about 50 volume percent of an Mg—Ni alloy, such as an alloy of Mg-5 wt. % Ni, and about 50 volume percent or more of a W—Ni alloy, such as an alloy of W-5 wt. % Ni. In these embodiments that are formed from a mixture of different powders 110 and powder particles 112 having different particle core materials 118, at least a portion (e.g., 50 volume percent or more) of the particle cores 114 have a density greater than 7.5 g/cm$^3$. In other embodiments, dispersed particles 214 may be formed from a powder 100 having powder particles 112 with particle cores 114 formed from particle core materials 118 that include alloys, wherein the alloy has a density greater than about 7.5 g/cm$^3$, such as may be formed from binary, ternary, etc. alloys having at least one alloy constituent with a density greater than about 7.5 g/cm$^3$. The particle cores 114 and particle core material of the liner 22 are preferably formed from ductile materials. In an exemplary embodiment, ductile materials include materials that exhibit 5% or more of true strain or elongation at failure or breaking.

In an exemplary embodiment, the shaped charge housing 16 and/or outer housing 14 may include dispersed particles 214 that are formed from particle cores 114 with any suitable particle core material, including, in one embodiment, the same particle core materials used to form the components of shaped charge 8. In another exemplary embodiment, they may be formed from dispersed particles 214 that are formed from particle cores 114 having a particle core material 118 comprising Mg, Al, Zn or Mn, or alloys thereof, or a combination thereof Dispersed particles 214 and particle core material 218 may also include a rare earth element, or a combination of rare earth elements. As used herein, rare earth elements include Sc, Y, La, Ce, Pr, Nd or Er, or a combination of rare earth elements. Where present, a rare earth element or combination of rare earth elements may be present, by weight, in an amount of about 5 percent or less.

Figure 7:
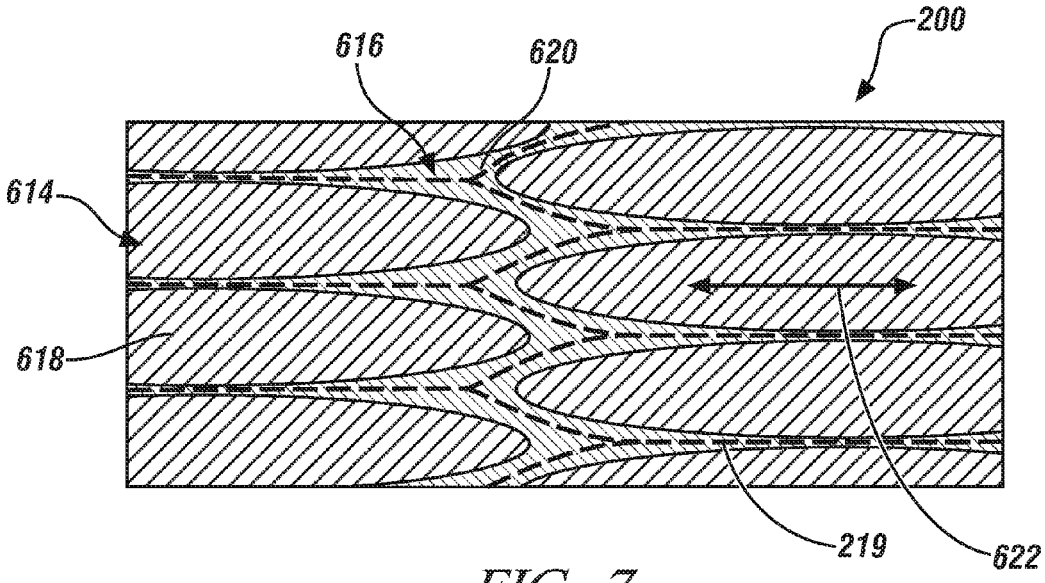
FIG. 7 is a schematic of illustration of an exemplary embodiment of the powder compact have a substantially elongated configuration of dispersed particles as disclosed herein.
Figure 8:
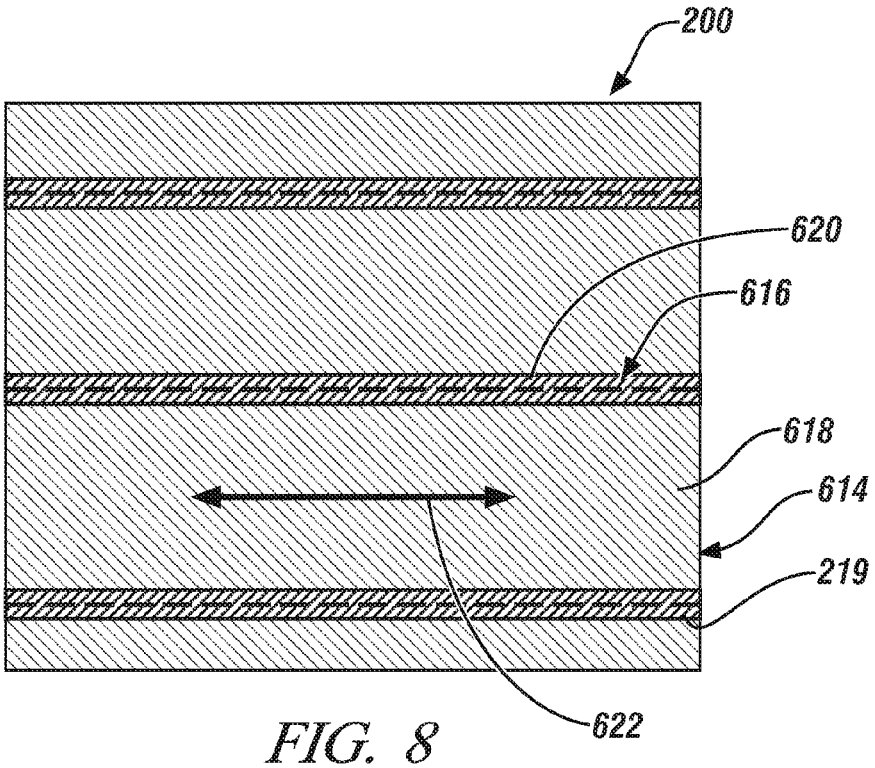
FIG. 8 is a schematic of illustration of an exemplary embodiment of the powder compact have a substantially elongated configuration of the cellular nanomatrix and dispersed particles, wherein the cellular nanomatrix and dispersed particles are substantially continuous.
Figure 9:
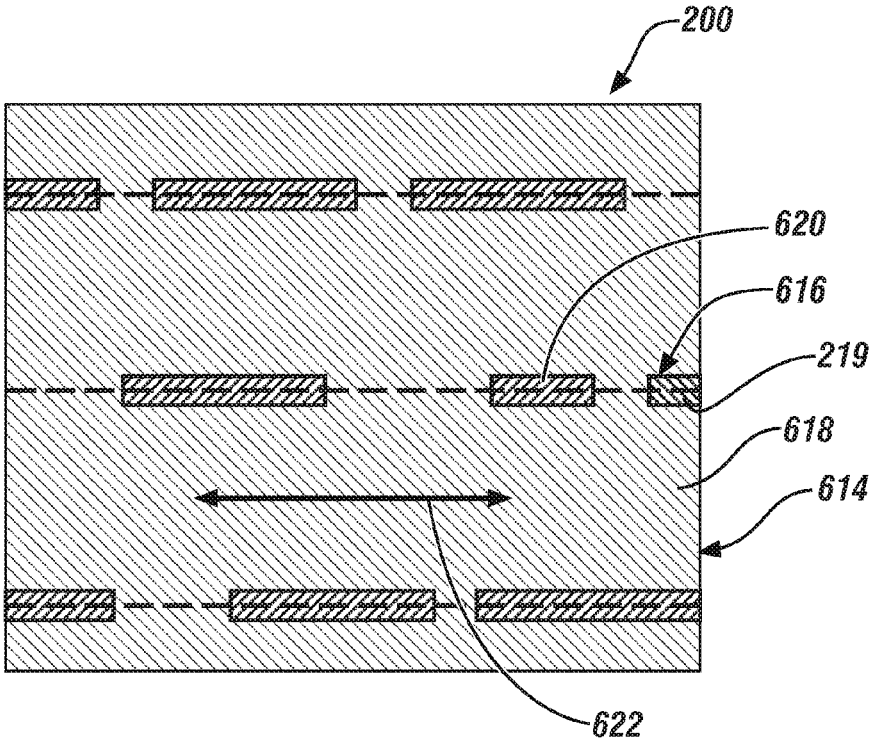
FIG. 9 is a schematic of illustration of an exemplary embodiment of the powder compact have a substantially elongated configuration of the cellular nanomatrix and dispersed particles, wherein the cellular nanomatrix and dispersed particles are substantially discontinuous.

Powder compact 200 includes a cellular nanomatrix 216 of a nanomatrix material 220 having a plurality of dispersed particles 214 dispersed throughout the cellular nanomatrix 216. The dispersed particles 214 may be equiaxed in a substantially continuous cellular nanomatrix 216 as illustrated in FIG. 6, or may be substantially elongated as described herein and illustrated in FIG. 7. In the case where the dispersed particles 214 are substantially elongated, the dispersed particles 214 and the cellular nanomatrix 216 may be continuous or discontinuous, as illustrated in FIGS. 8 and 9, respectively. The substantially-continuous cellular nanomatrix 216 and nanomatrix material 220 formed of sintered metallic coating layers 116 is formed by the compaction and sintering of the plurality of metallic coating layers 116 of the plurality of powder particles 112, such as by CIP, HIP or dynamic forging. The chemical composition of nanomatrix material 220 may be different than that of coating material 120 due to diffusion effects associated with the sintering. Powder metal compact 200 also includes a plurality of dispersed particles 214 that comprise particle core material 218. Dispersed particle 214 and core material 218 correspond to and are formed from the plurality of particle cores 114 and core material 118 of the plurality of powder particles 112 as the metallic coating layers 116 are sintered together to form nanomatrix 216. The chemical composition of core material 218 may also be different than that of core material 118 due to diffusion effects associated with sintering.

As used herein, the use of the term cellular nanomatrix 216 does not connote the major constituent of the powder compact, but rather refers to the minority constituent or constituents, whether by weight or by volume. This is distinguished from most matrix composite materials where the matrix comprises the majority constituent by weight or volume. The use of the term substantially-continuous, cellular nanomatrix is intended to describe the extensive, regular, continuous and interconnected nature of the distribution of nanomatrix material 220 within powder compact 200. As used herein, "substantially-continuous" describes the extension of the nanomatrix material throughout powder compact 200 such that it extends between and envelopes substantially all of the dispersed particles 214. Substantially-continuous is used to indicate that complete continuity and regular order of the nanomatrix around each dispersed particle 214 is not required. For example, defects in the coating layer 116 over particle core 114 on some powder particles 112 may cause bridging of the particle cores 114 during sintering of the powder compact 200, thereby causing localized discontinuities to result within the cellular nanomatrix 216, even though in the other portions of the powder compact the nanomatrix is substantially continuous and exhibits the structure described herein. In contrast, in the case of substantially elongated dispersed particles 214, such as those formed by extrusion, "substantially discontinuous" is used to indicate that incomplete continuity and disruption (e.g., cracking or separation) of the nanomatrix around each dispersed particle 214, such as may occur in a predetermined extrusion direction 622, or a direction transverse to this direction. As used herein, "cellular" is used to indicate that the nanomatrix defines a network of generally repeating, interconnected, compartments or cells of nanomatrix material 220 that encompass and also interconnect the dispersed particles 214. As used herein, "nanomatrix" is used to describe the size or scale of the matrix, particularly the thickness of the matrix between adjacent dispersed particles 214. The metallic coating layers that are sintered together to form the nanomatrix are themselves nanoscale thickness coating layers. Since the nanomatrix at most locations, other than the intersection of more than two dispersed particles 214, generally comprises the interdiffusion and bonding of two coating layers 116 from adjacent powder particles 112 having nanoscale thicknesses, the matrix formed also has a nanoscale thickness (e.g., approximately two times the coating layer thickness as described herein) and is thus described as a nanomatrix. Further, the use of the term dispersed particles 214 does not connote the minor constituent of powder compact 200, but rather refers to the majority constituent or constituents, whether by weight or by volume. The use of the term dispersed particle is intended to convey the discontinuous and discrete distribution of particle core material 218 within powder compact 200.

Particle cores 114 and dispersed particles 214 of powder compact 200 may have any suitable particle size. In an exemplary embodiment, the particle cores 114 may have a unimodal distribution and an average particle diameter or size of about 5 μm to about 300 μm, more particularly about 80 μm to about 120 μm, and even more particularly about 100 μm. In another exemplary embodiment, which may include a multimodal distribution of particle sizes, the particle cores 114 may have average particle diameters or size of about 50 nm to about 500 μm, more particularly about 500 nm to about 300 μm, and even more particularly about 5 μm to about 300 μm.

In an exemplary embodiment, the particle cores 114 or the dispersed particles may have an average particle size of about 50 nm to about 500 μm.

Dispersed particles 214 may have any suitable shape depending on the shape selected for particle cores 114 and powder particles 112, as well as the method used to sinter and compact powder 100. In an exemplary embodiment, powder particles 112 may be spheroidal or substantially spheroidal and dispersed particles 214 may include an equiaxed particle configuration as described herein. In another exemplary embodiment as shown in FIGS. 7-9, dispersed particles may have a non-spherical shape. In yet another embodiment, the dispersed particles may be substantially elongated in a predetermined extrusion direction 622, such as may occur when using extrusion to form powder compact 200. As illustrated in FIGS. 7-9, for example, a substantially elongated cellular nanomatrix 616 comprising a network of interconnected elongated cells of nanomatrix material 620 having a plurality of substantially elongated dispersed particle cores 614 of core material 618 disposed within the cells. Depending on the amount of deformation imparted to form elongated particles, the elongated coating layers and the nanomatrix 616 may be substantially continuous in the predetermined direction 622 as shown in FIG. 4, or substantially discontinuous as shown in FIG. 5.

The nature of the dispersion of dispersed particles 214 may be affected by the selection of the powder 100 or powders 100 used to make particle compact 200. In one exemplary embodiment, a powder 100 having a unimodal distribution of powder particle 112 sizes may be selected to form powder compact 200 and will produce a substantially homogeneous unimodal dispersion of particle sizes of dispersed particles 214 within cellular nanomatrix 216. In another exemplary embodiment, a plurality of powders 100 having a plurality of powder particles with particle cores 114 that have the same core materials 118 and different core sizes and the same coating material 120 may be selected and uniformly mixed as described herein to provide a powder 100 having a homogenous, multimodal distribution of powder particle 112 sizes, and may be used to form powder compact 200 having a homogeneous, multimodal dispersion of particle sizes of dispersed particles 214 within cellular nanomatrix 216. Similarly, in yet another exemplary embodiment, a plurality of powders 100 having a plurality of particle cores 114 that may have the same core materials 118 and different core sizes and the same coating material 120 may be selected and distributed in a non-uniform manner to provide a non-homogenous, multimodal distribution of powder particle sizes, and may be used to form powder compact 200 having a non-homogeneous, multimodal dispersion of particle sizes of dispersed particles 214 within cellular nanomatrix 216. The selection of the distribution of particle core size may be used to determine, for example, the particle size and interparticle spacing of the dispersed particles 214 within the cellular nanomatrix 216 of powder compacts 200 made from powder 100.

As illustrated generally in FIGS. 5 and 6, powder metal compact 200 may also be formed using coated metallic powder 100 and an additional or second powder 130, as described herein. The use of an additional powder 130 provides a powder compact 200 that also includes a plurality of dispersed second particles 234, as described herein, that are dispersed within the nanomatrix 216 and are also dispersed with respect to the dispersed particles 214. Dispersed second particles 234 may be formed from coated or uncoated second powder particles 132, as described herein. In an exemplary embodiment, coated second powder particles 132 may be coated with a coating layer 136 that is the same as coating layer 116 of powder particles 112, such that coating layers 136 also contribute to the nanomatrix 216. In another exemplary embodiment, the second powder particles 234 may be uncoated such that dispersed second particles 234 are embedded within nanomatrix 216. As disclosed herein, powder 100 and additional powder 130 may be mixed to form a homogeneous dispersion of dispersed particles 214 and dispersed second particles 234 or to form a non-homogeneous dispersion of these particles. The dispersed second particles 234 may be formed from any suitable additional powder 130 that is different from powder 100, either due to a compositional difference in the particle core 134, or coating layer 136, or both of them, and may include any of the materials disclosed herein for use as second powder 130 that are different from the powder 100 that is selected to form powder compact 200. In an exemplary embodiment, dispersed second particles 234 may include Ni, Fe, Cu, Co, W, Al, Zn, Mn or Si, or an oxide, nitride, carbide, intermetallic compound or cermet comprising at least one of the foregoing, or a combination thereof.

Nanomatrix 216 is formed by sintering metallic coating layers 116 of adjacent particles to one another by interdiffusion and creation of bond layer 219 as described herein. Metallic coating layers 116 may be single layer or multilayer structures, and they may be selected to promote or inhibit diffusion, or both, within the layer or between the layers of metallic coating layer 116, or between the metallic coating layer 116 and particle core 114, or between the metallic coating layer 116 and the metallic coating layer 116 of an adjacent powder particle, the extent of interdiffusion of metallic coating layers 116 during sintering may be limited or extensive depending on the coating thicknesses, coating material or materials selected, the sintering conditions and other factors. Given the potential complexity of the interdiffusion and interaction of the constituents, description of the resulting chemical composition of nanomatrix 216 and nanomatrix material 220 may be simply understood to be a combination of the constituents of coating layers 16 that may also include one or more constituents of dispersed particles 214, depending on the extent of interdiffusion, if any, that occurs between the dispersed particles 214 and the nanomatrix 216. Similarly, the chemical composition of dispersed particles 214 and particle core material 218 may be simply understood to be a combination of the constituents of particle core 114 that may also include one or more constituents of nanomatrix 216 and nanomatrix material 220, depending on the extent of interdiffusion, if any, that occurs between the dispersed particles 214 and the nanomatrix 216.

In an exemplary embodiment, the nanomatrix material 220 has a chemical composition and the particle core material 218 has a chemical composition that is different from that of nanomatrix material 220, and the differences in the chemical compositions may be configured to provide a selectable and controllable dissolution rate, including a selectable transition from a very low dissolution rate to a very rapid dissolution rate, in response to a controlled change in a property or condition of the wellbore proximate the compact 200, including a property change in a wellbore fluid that is in contact with the powder compact 200, as described herein. Nanomatrix 216 may be formed from powder particles 112 having single layer and multilayer coating layers 116. This design flexibility provides a large number of material combinations, particularly in the case of multilayer coating layers 116, that can be utilized to tailor the cellular nanomatrix 216 and composition of nanomatrix material 220 by controlling the interaction of the coating layer constituents, both within a given layer, as well as between a coating layer 116 and the particle core 114 with which it is associated or a coating layer 116 of an adjacent powder particle 112. Several exemplary embodiments that demonstrate this flexibility are provided below.

As illustrated in FIGS. 5 and 6, in an exemplary embodiment, powder compact 200 is formed from powder particles 112 where the coating layer 116 comprises a single layer, and the resulting nanomatrix 216 between adjacent ones of the plurality of dispersed particles 214 comprises the single metallic coating layer 116 of one powder particle 112, a bond layer 219 and the single coating layer 116 of another one of the adjacent powder particles 112. The thickness of bond layer 219 is determined by the extent of the interdiffusion between the single metallic coating layers 16, and may encompass the entire thickness of nanomatrix 216 or only a portion thereof In other words, the compact is formed from a sintered powder 100 comprising a plurality of powder particles 112, each powder particle 112 having a particle core that upon sintering comprises a dispersed particle 114 and a single metallic coating layer 116 disposed thereon, and wherein the cellular nanomatrix 216 between adjacent ones of the plurality of dispersed particles 214 comprises the single metallic coating layer 116 of one powder particle 16, the bond layer 219 and the single metallic coating layer 116 of another of the adjacent powder particles 112. In another embodiment, the powder compact 200 is formed from a sintered powder 100 comprising a plurality of powder particles 112, each powder particle 112 having a particle core 114 that upon sintering comprises a dispersed particle 214 and a plurality of metallic coating layers 116 disposed thereon, and wherein the cellular nanomatrix 216 between adjacent ones of the plurality of dispersed particles 214 comprises the plurality of metallic coating layers 116 of one powder particle 112, the bond layer 219 and the plurality of metallic coating layers 116 of another of the powder particles 112, and wherein adjacent ones of the plurality of metallic coating layers 116 have different chemical compositions.

The cellular nanomatrix 216 may have any suitable nanoscale thickness. In an exemplary embodiment, the cellular nanomatrix 216 has an average thickness of about 50 nm to about 5000 nm.

In one exemplary embodiment, nanomatrix 216 may include Al, Zn, Mn, Mg, Mo, W, Cu, Fe, Si, Ca, Co, Ta, Re or Ni, or an oxide, carbide or nitride thereof, or a combination of any of the aforementioned materials, including combinations where the nanomatrix material 220 of cellular nanomatrix 216, including bond layer 219, has a chemical composition and the core material 218 of dispersed particles 214 has a chemical composition that is different than the chemical composition of nanomatrix material 220. The difference in the chemical composition of the nanomatrix material 220 and the core material 218 may be used to provide selectable and controllable dissolution in response to a change in a property of a wellbore, including a wellbore fluid, as described herein.

Powder compact 200 may have any desired shape or size, including that of a cylindrical billet, bar, sheet or other form that may be machined, formed or otherwise used to form useful articles of manufacture, including various wellbore tools and components. The pressing used to form precursor powder compact 100 and sintering and pressing processes used to form powder compact 200 and deform the powder particles 112, including particle cores 114 and coating layers 116, to provide the full density and desired macroscopic shape and size of powder compact 200 as well as its microstructure. The morphology (e.g. equiaxed or substantially elongated) of the dispersed particles 214 and nanomatrix 216 of particle layers results from sintering and deformation of the powder particles 112 as they are compacted and interdiffuse and deform to fill the interparticle spaces 115 (FIG. 1). The sintering temperatures and pressures may be selected to ensure that the density of powder compact 200 achieves substantially full theoretical density.

The powder compact 200 may be formed by any suitable forming method, including uniaxial pressing, isostatic pressing, roll forming, forging, or extrusion at a forming temperature. The forming temperature may be any suitable forming temperature. In one embodiment, the forming temperature may comprise an ambient temperature, and the powder compact 200 may have a density that is less than the full theoretical density of the particles 112 that form compact 200, and may include porosity. In another embodiment, the forming temperature the forming temperature may comprise a temperature that is about is about 20° C. to about 300° C. below a melting temperature of the powder particles, and the powder compact 200 may have a density that is substantially equal to the full theoretical density of the particles 112 that form the compact, and may include substantially no porosity.

The terms "a" and "an" herein do not denote a limitation of quantity, but rather denote the presence of at least one of the referenced items. The modifier "about" used in connection with a quantity is inclusive of the stated value and has the meaning dictated by the context (e.g., includes the degree of error associated with measurement of the particular quantity). Furthermore, unless otherwise limited all ranges disclosed herein are inclusive and combinable (e.g., ranges of "up to about 25 weight percent (wt. %), more particularly about 5 wt. % to about 20 wt. % and even more particularly about 10 wt. % to about 15 wt. %" are inclusive of the endpoints and all intermediate values of the ranges, e.g., "about 5 wt. % to about 25 wt. %, about 5 wt. % to about 15 wt. %", etc.). The use of "about" in conjunction with a listing of constituents of an alloy composition is applied to all of the listed constituents, and in conjunction with a range to both endpoints of the range. Finally, unless defined otherwise, technical and scientific terms used herein have the same meaning as is commonly understood by one of skill in the art to which this invention belongs. The suffix "(s)" as used herein is intended to include both the singular and the plural of the term that it modifies, thereby including one or more of that term (e.g., the metal(s) includes one or more metals). Reference throughout the specification to "one embodiment", "another embodiment", "an embodiment", and so forth, means that a particular element (e.g., feature, structure, and/or characteristic) described in connection with the embodiment is included in at least one embodiment described herein, and may or may not be present in other embodiments.

It is to be understood that the use of "comprising" in conjunction with the alloy compositions described herein specifically discloses and includes the embodiments wherein the alloy compositions "consist essentially of" the named components (i.e., contain the named components and no other components that significantly adversely affect the basic and novel features disclosed), and embodiments wherein the alloy compositions "consist of" the named components (i.e., contain only the named components except for contaminants which are naturally and inevitably present in each of the named components).

While one or more embodiments have been shown and described, modifications and substitutions may be made thereto without departing from the spirit and scope of the invention. Accordingly, it is to be understood that the present invention has been described by way of illustrations and not limitation.

The invention claimed is:

1. A method for perforating a formation interval in a well, comprising:

disposing a perforation gun comprising, a shaped charge in the well proximate the formation interval, wherein the shaped charge comprises a charge case having a charge cavity, a liner disposed within the charge cavity and an explosive disposed within the charge cavity between the liner and the charge case, wherein the charge case and liner are each formed from a selectively corrodible powder compact material, wherein the selectively corrodible powder compact materials of the liner and the charge case comprise a cellular nanomatrix comprising:

a nanomatrix material;

a plurality of dispersed particles dispersed in the cellular nanomatrix, the plurality of dispersed particles consisting of particle core materials having a density of 7.5 g/cm$^3$ or more; and a bond layer extending throughout the cellular nanomatrix between the dispersed particles, the cellular nanomatrix configured to provide a mechanical shock impedance or mechanical shock response that enables containment of an explosion of the explosive by the shaped charge housing and formation of a jet from the liner;

a shaped charge housing that is formed from a selectively corrodible powder compact material and configured to house the shaped charge; and an outer housing that is formed from a selectively corrodible powder compact material and is configured to house the shaped charge housing;

detonating the shaped charge to form a perforation tunnel in the formation interval and deposit a liner residue in the perforation tunnel; and exposing the perforation gun and perforation tunnel to a predetermined wellbore fluid after detonating the shaped charge to remove a liner residue from the perforation tunnel and the charge case, shaped charge housing, and outer housing from the well.

2. The method of claim 1, wherein the shaped charge housing is formed from a selectively corrodible powder compact material that is different than the selectively corrodible powder compact material of the charge case and the liner.

3. The method of claim 1, wherein the particle core material has a density of about 8.5 g/cm$^3$ or more.

4. The method of claim 1, wherein the particle core material has a density of about 10 g/cm$^3$ or more.

5. The method of claim 1, wherein the particle core material comprises a metal, ceramic, cermet, glass or carbon, or a composite thereof, or a combination of any of the foregoing materials.

6. The method of claim 1, wherein the particle core material comprises Fe, Ni, Cu, W, Mo, Ta, U or Co, or a carbide, oxide or nitride comprising at least one of the foregoing metals, or an alloy comprising at least one of the aforementioned materials, or a composite comprising at least one of the aforementioned materials, or a combination of any of the foregoing.

7. The method of claim 1, wherein the shaped charge housing comprises:

a cellular nanomatrix comprising a nanomatrix material;

a plurality of dispersed particles comprising a particle core material that comprises Mg, Al, Zn or Mn, or a combination thereof; and a bond layer extending throughout the cellular nanomatrix between the dispersed particles.

8. The method of claim 7, wherein the nanomatrix material comprises Al, Zn, Mn, Mg, Mo, W, Cu, Fe, Si, Ca, Co, Ta, Re or Ni, or an oxide, carbide or nitride thereof, or a combination of any of the aforementioned materials, and wherein the nanomatrix material has a chemical composition and the particle core material has a chemical composition that is different than the chemical composition of the nanomatrix material.

9. The method of claim 1, wherein the shaped charge housing comprises:

a cellular nanomatrix comprising a nanomatrix material;

a plurality of dispersed particles comprising a particle core material that comprises Mg, Al, Zn or Mn, or a combination thereof; and a bond layer extending throughout the cellular nanomatrix between the dispersed particles.

10. The method of claim 9, wherein the nanomatrix material comprises Al, Zn, Mn, Mg, Mo, W, Cu, Fe, Si, Ca, Co, Ta, Re or Ni, or an oxide, carbide or nitride thereof, or a combination of any of the aforementioned materials, and wherein the nanomatrix material has a chemical composition and the particle core material has a chemical composition that is different than the chemical composition of the nanomatrix material.

11. The method of claim 1, wherein the predetermined wellbore fluid comprises an acid, an injection fluid, a fracturing fluid, or a completions fluid.

12. The method of claim 1, wherein the outer housing is formed from a selectively corrodible powder compact material that is different than the selectively corrodible powder compact material of the charge case and the liner.

13. The method of claim 1, wherein the at least one of the plurality of particle core materials comprise ductile materials.

14. The method of claim 13, wherein the ductile materials exhibit a true strain at breaking of 5% or more.

15. A method for perforating a formation interval in a well, comprising:

disposing a perforation gun comprising a shaped charge and a separate galvanic member disposed on and galvanically coupled to the shaped charge in the well proximate the formation interval, the shaped charge comprising a charge case having a charge cavity, a liner disposed within the charge cavity and an explosive disposed within the charge cavity between the liner and the charge case, the charge case and liner each formed from a selectively corrodible powder compact material;

detonating the shaped charge to form a perforation tunnel in the formation interval and deposit a liner residue in the perforation tunnel; and exposing the perforation gun, galvanic member, and perforation tunnel to a predetermined wellbore fluid after detonating the shaped charge to remove a liner residue from the perforation tunnel and the charge case from the well.

* * * * *